US007612746B2

(12) United States Patent
Kimura

(10) Patent No.: US 7,612,746 B2
(45) Date of Patent: Nov. 3, 2009

(54) LIGHT EMITTING DEVICE AND ELECTRONIC DEVICE

(75) Inventor: Hajime Kimura, Kanagawa (JP)

(73) Assignee: Semiconductor Energy Laboratory Co., Ltd. (JP)

( * ) Notice: Subject to any disclaimer, the term of this patent is extended or adjusted under 35 U.S.C. 154(b) by 699 days.

(21) Appl. No.: 11/442,456

(22) Filed: May 26, 2006

(65) Prior Publication Data

US 2006/0221013 A1 Oct. 5, 2006

Related U.S. Application Data

(63) Continuation of application No. 10/079,072, filed on Feb. 20, 2002, now Pat. No. 7,061,451.

(30) Foreign Application Priority Data

Feb. 21, 2001 (JP) ..... 2001-044367

(51) Int. Cl.
*G09G 3/30* (2006.01)

(52) U.S. Cl. ..... 345/76; 345/55; 345/92; 345/211; 315/169.1; 315/169.3; 315/169.4

(58) Field of Classification Search ..... 345/55, 345/76, 82, 84, 90, 92, 98, 204, 211; 315/169.1–169.4, 315/291
See application file for complete search history.

(56) References Cited

U.S. PATENT DOCUMENTS 5,576,857 A 11/1996 Takemura ..... 359/59
5,731,795 A 3/1998 Kanda et al. ..... 345/87
5,818,068 A 10/1998 Sasaki et al. ..... 257/59

(Continued)

FOREIGN PATENT DOCUMENTS

EP 1 026 656 A2 8/2000

(Continued)

OTHER PUBLICATIONS

U.S. Appl. No. 09/724,387 (pending) to Inukai filed Nov. 28, 2000, including specification, claims, abstract, drawings and PTO filing receipt.

(Continued)

*Primary Examiner*—Henry N Tran
(74) *Attorney, Agent, or Firm*—Cook Alex Ltd.

(57) ABSTRACT

There is provided a light emitting device capable of preventing light emission of an OLED caused due to an off current of a driver TFT and suppressing a reduction in a contrast, to thereby display a beautiful image. A wiring which is kept at a predetermined potential (hereinafter referred to as a discharge line) is provided to make the off current flow into the discharge line rather than into the OLED. A TFT such as is turned on when the driver TFT is tuned off (hereinafter referred to as a discharging TFT) is provided in each pixel. With respect to the source region and the drain region of the discharging TFT, one is connected with a pixel electrode and the other is connected with the discharge line. According to the above structure, when the driver TFT is turned off, the discharging TFT is turned on. Thus, the off current in the driver TFT actively flows into the discharge line rather than into the OLED.

18 Claims, 14 Drawing Sheets

U.S. PATENT DOCUMENTS

| | | | | |
|---|---|---|---|---|
| 5,888,858 | A | 3/1999 | Yamazaki et al. | 438/162 |
| 5,903,248 | A | 5/1999 | Irwin | 345/90 |
| 5,952,789 | A | 9/1999 | Stewart et al. | 315/169.4 |
| 6,011,532 | A | 1/2000 | Yanai et al. | 345/92 |
| 6,091,203 | A | 7/2000 | Kawashima et al. | 315/169.3 |
| 6,229,506 | B1 | 5/2001 | Dawson et al. | 345/82 |
| 6,246,180 | B1 * | 6/2001 | Nishigaki | 315/169.3 |
| 6,486,606 | B1 * | 11/2002 | Ting | 315/169.1 |
| 6,512,469 | B1 | 1/2003 | Azami et al. | |
| 6,535,185 | B2 | 3/2003 | Kim et al. | 345/76 |
| 6,542,138 | B1 * | 4/2003 | Shannon et al. | 345/76 |
| 6,545,656 | B1 | 4/2003 | Yamazaki | |
| 6,570,338 | B2 | 5/2003 | Bae | 315/169.3 |
| 6,628,363 | B1 | 9/2003 | Sano et al. | 349/151 |
| 6,724,151 | B2 * | 4/2004 | Yoo | 315/169.3 |
| 6,730,966 | B2 | 5/2004 | Koyama | 257/350 |
| 6,750,792 | B2 | 6/2004 | Azami et al. | |
| 6,753,656 | B2 | 6/2004 | Kimura | 315/169.3 |
| 6,774,574 | B1 | 8/2004 | Koyama | |
| 6,777,887 | B2 | 8/2004 | Koyama | |
| 7,049,983 | B2 | 5/2006 | Azami et al. | |
| 7,088,327 | B2 | 8/2006 | Yamazaki | |
| 7,355,534 | B2 | 4/2008 | Azami et al. | |
| 7,358,531 | B2 | 4/2008 | Koyama | |
| 2002/0053884 | A1 | 5/2002 | Kimura | 315/169.3 |
| 2006/0267899 | A1 | 11/2006 | Yamazaki | |

FOREIGN PATENT DOCUMENTS

| | | | |
|---|---|---|---|
| EP | 1 061 497 | | 12/2000 |
| EP | 1 063 630 | A2 | 12/2000 |
| JP | 10-319908 | | 12/1998 |
| JP | 2000-221942 | | 8/2000 |
| JP | 2000-235370 | | 8/2000 |
| JP | 2000-338919 | | 12/2000 |
| JP | 2000-338920 | | 12/2000 |
| JP | 2000-347621 | | 12/2000 |
| JP | 2001-5426 | | 1/2001 |
| JP | 2001-34231 | | 2/2001 |
| JP | 2001-42290 | | 2/2001 |
| JP | 2001-042822 | | 2/2001 |
| JP | 2001-060076 | | 3/2001 |

OTHER PUBLICATIONS

U.S. Appl. No. 09/725,798 (pending) to Koyama, including specification, claims, abstract, drawings and PTO filing receipt.

U.S. Appl. No. 09/747,646 (pending) to Inukai filed Dec. 22, 2000, including specification, claims, abstract, drawings and PTO filing receipt.

U.S. Appl. No. 09/836,719 (pending) to Kimura et al, including specification, claims, abstract, drawings and PTO filing receipt.

U.S. Appl. No. 09/840,584 (pending) to Inukai, including specification, claims, abstract, drawings and PTO filing receipt.

U.S. Appl. No. 09/992,569 (pending) to Kimura, including specification, claims, abstract, drawings and PTO filing receipt.

U.S. Appl. No. 09/841,098 (pending) including specification, claims, abstract and drawings.

U.S. Appl. No. 09/886,148 (pending) to Inukai, including specification, claims, abstract, drawings, and PTO filing receipt.

Tsutsui, T., et al, "Electroluminescence in Organic Thin Films," Photochemical Processes in Organized Molecular Systems, pp. 437-450, (1991).

Baldo, M.A. et al, "Highly Efficient Phosphorescent Emission from Organic Electroluminescent Devices," Nature, vol. 395, pp. 151-154, Sep. 10, 1998.

Baldo, M.A. et al, "Very High-Efficiency Green Organic Light-Emitting Devices Based on Electrophosphorescence," Applied Physics Letters, vol. 75, No. 1, pp. 4-6, Jul. 5, 1999.

Tsutsui, T. et al, "High Quantum Efficiency in Organic Light-Emitting Devices with Iridium-Complex as a Triplet Emissive Center," Japanese Journal of Applied Physics, vol. 38, part 2, No. 12B, pp. L 1502-L 1504, Dec. 15, 1999.

* cited by examiner 902
903
907
906
904
900
901a
901b
901
905

909
908
910
908
911a
908
911b
908
912

914
914
915
915
916
916
916
917
917

918
922
919
922
920a
922
920b
922
921
922

LIGHT EMITTING DEVICE AND ELECTRONIC DEVICE

This application is a continuation of application Ser. No. 10/079,072 filed on Feb. 20, 2002 now U.S. Pat. No. 7,061,451.

BACKGROUND OF THE INVENTION

1. Field of the Invention

The present invention relates to an OLED (organic light emitting device) panel obtained by forming an OLED on a substrate and sealing the OLED between the substrate and a cover member. The invention also relates to an OLED module in which an IC including a controller, or the like, is mounted to the OLED panel. In this specification, light emitting device is the generic term for the OLED panel and for the OLED module. Electronic devices using the light emitting device are also included in the present invention.

2. Description of the Related Art

Being self-luminous, OLEDs eliminate the need for a backlight that is necessary in liquid crystal display devices (LCDs) and thus make it easy to manufacture thinner devices. Also, the self-luminous OLEDs are high in visibility and have no limitation in terms of viewing angle. These are the reasons for the attention that light emitting devices using the OLEDs are receiving in recent years as display devices to replace CRTs and LCDs.

An OLED has a layer containing an organic compound (organic light emitting material) that provides luminescence (electroluminescence) when an electric field is applied (the layer is hereinafter referred to as organic light emitting layer), in addition to an anode layer and a cathode layer. Luminescence obtained from organic compounds is classified into light emission upon return to the base state from singlet excitation (fluorescence) and light emission upon return to the base state from triplet excitation (phosphorescence). A light emitting device according to the present invention can use one or both types of the light emission.

In this specification, all the layers that are provided between an anode and a cathode together make an organic light emitting layer. Specifically, the organic light emitting layer includes a light emitting layer, a hole injection layer, an electron injection layer, a hole transporting layer, an electron transporting layer, etc. A basic structure of an OLED is a laminate of an anode, a light emitting layer, and a cathode layered in this order. The basic structure can be modified into a laminate of an anode, a hole injection layer, a light emitting layer, and a cathode layered in this order, or a laminate of an anode, a hole injection layer, a light emitting layer, an electron transporting layer, and a cathode layered in this order.

Hereinafter, a structure of a pixel in a general light emitting device will be described using FIG. 15.

In a pixel portion of a general light emitting device, a plurality of pixels 1000 are provided in a matrix shape. Each pixel 1000 includes at least one signal line 1001, at least one scan line 1002, and at least one power source line 1003.

Also, the pixel 1000 includes a switching TFT 1004, a driver TFT 1005, an OLED 1006, and a storage capacitor 1007.

The gate electrode of the switching TFT 1004 is connected with the scan line 1002. With respect to the source region and the drain region of the switching TFT 1004, one is connected with the signal line 1001 and the other is connected with the gate electrode of the driver TFT 1005.

The storage capacitor 1007 is formed between the gate electrode of the driver TFT 1005 and the power source line 1003. The storage capacitor 1007 is provided to hold a gate voltage (difference of potential between the gate electrode and the source region) of the driver TFT 1005 in the case when the switching TFT 1004 is in a non-select state (off state).

Also, with respect to the source region and the drain region of the driver TFT 1005, one is connected with the power source line 1003 and the other is connected with the OLED 1006.

The OLED 1006 is composed of an anode, a cathode, and an organic light emitting layer provided between the anode and cathode. When the anode is connected with the source region or the drain region of the driver TFT 1005, the anode is called a pixel electrode and the cathode is called a counter electrode. On the other hand, when the cathode is connected with the source region or the drain region of the driver TFT 1005, the cathode is called a pixel electrode and the anode is called a counter electrode.

A potential (counter potential) is applied to the counter electrode of the OLED 1006 by a power source provided outside an OLED panel. Also, a potential (power source potential) is applied to the power source line 1003 by the power source provided outside the OLED panel.

Next, an operation of the pixel 1000 shown in FIG. 15 will be described.

When the scan line 1002 is selected in response to a selection signal inputted to the scan line 1002, the switching TFT 1004 in which the gate electrode is connected with the scan line 1002 becomes an on state. Note that, in this specification, the selection of the scan line means that all TFTs in which the gate electrodes are connected with the scan line are tuned on.

Then, a video signal having image information inputted to the signal line 1001 is inputted to the gate electrode of the driver TFT 1005 through the switching TFT 1004 which is turned on.

In accordance with a potential of the video signal inputted to the gate electrode, a gate voltage of the driver TFT 1005 is determined. A current of a value corresponding to the gate voltage flows into the channel forming region of the driver TFT 1005. The current flowing into the channel forming region of the driver TFT 1005 flows into the OLED 1006.

When the current flows into the OLED 1006, the OLED 1006 emits light. When the above operation is performed for all pixels, an image is thus displayed on the display portion.

Now, the driver TFT is ideal to be in a normally off state. For example, the following configuration is ideal in the case of a p-channel TFT. That is, when a gate voltage (potential between the source region and the drain region) is larger than a threshold value, a drain current does not flow. On the other hand, only when the gate voltage becomes smaller than the threshold value, the drain current starts to flow. Also, the following configuration is ideal in the case of an n-channel TFT. That is, when the gate voltage is smaller than the threshold value, the drain current does not flow. On the other hand, only when the gate voltage becomes larger than the threshold value, the drain current starts to flow. Note that, in this specification, the increase in the gate voltage means that the gate voltage is changed in a positive direction and the decrease in the gate voltage means that the gate voltage is changed in a negative direction.

The threshold voltage is ideal to be a negative value in the case of a p-channel TFT. On the other hand, the threshold voltage is ideal to be a positive value in the case of an n-channel TFT.

However, actually, the threshold voltage of a TFT is shifted somewhat according to a manufacturing step. When the threshold voltage is shifted, there is the case where the driver TFT which should become an off state is turned on. When the driver TFT which should become an off state is turned on, the drain current flows into the channel forming region of the driver TFT and then the OLED emits light even when light emission is not required. This becomes a cause of reduced contrast or disturbed display image.

Also, there is a case where a current flowing in an off state (off current) becomes large, depending on a characteristic of a TFT. When the off current of the driver TFT is large, such a current flows into the OLED: Thus, the OLED emits light even when light emission is not required.

In order to reduce an off current, there are proposed a method of increasing a channel length of the driver TFT and a method of increasing the number of gate electrodes to obtain a multi-gate structure. However, in either of the methods, there is a limitation regarding reduction in the off current.

SUMMARY OF THE INVENTION

The present invention has been made in view of the above problems, and an object of the present invention is therefore to provide a light emitting device capable of preventing light emission of the OLED due to an off current of the driver TFT and suppressing a reduction in a contrast, to thereby display a beautiful image.

On the condition that an off current is present in the driver TFT, the present inventor conceived of forming a shunt circuit for relieving the off current so as not to allow the off current to flow into the OELD.

Specifically, a wiring which is kept at a predetermined potential (hereinafter referred to as a discharge line) is provided, and the off current is made to flow into the discharge line rather than into the OLED. And, a TFT which is turned on when the driver TFT is turned off (hereinafter referred to as a discharging TFT) is provided for each pixel. With respect to the source region and the drain region of the discharging TFT, one is connected with a pixel electrode and the other is connected with the discharge line.

According to the above structure, when the driver TFT is turned on, the discharging TFT is turned off and the drain current of the driver TFT flows into the OLED. On the other hand, when the driver TFT is turned off, the discharging TFT is turned on and the drain current of the driver TFT (off current in this case) actively flows into the discharge line rather than into the OLED.

Note that, with respect to the discharging TFT and the driver TFT, one is used as a p-channel TFT, the other is used as an n-channel TFT, and the gate electrodes of both TFTs are electrically connected with each other. Thus, when one TFT is turned on, the other TFT can be turned off.

According to the above structure, even if the off current flows into the driver TFT, light emission of the OLED is prevented, a reduction in a contrast is suppressed, and disturbance of a displayed image can be prevented.

DETAILED DESCRIPTION OF THE PREFERRED EMBODIMENTS

Hereinafter, a structure of a light emitting device of the present invention will be described in detail.

Figure 1A:
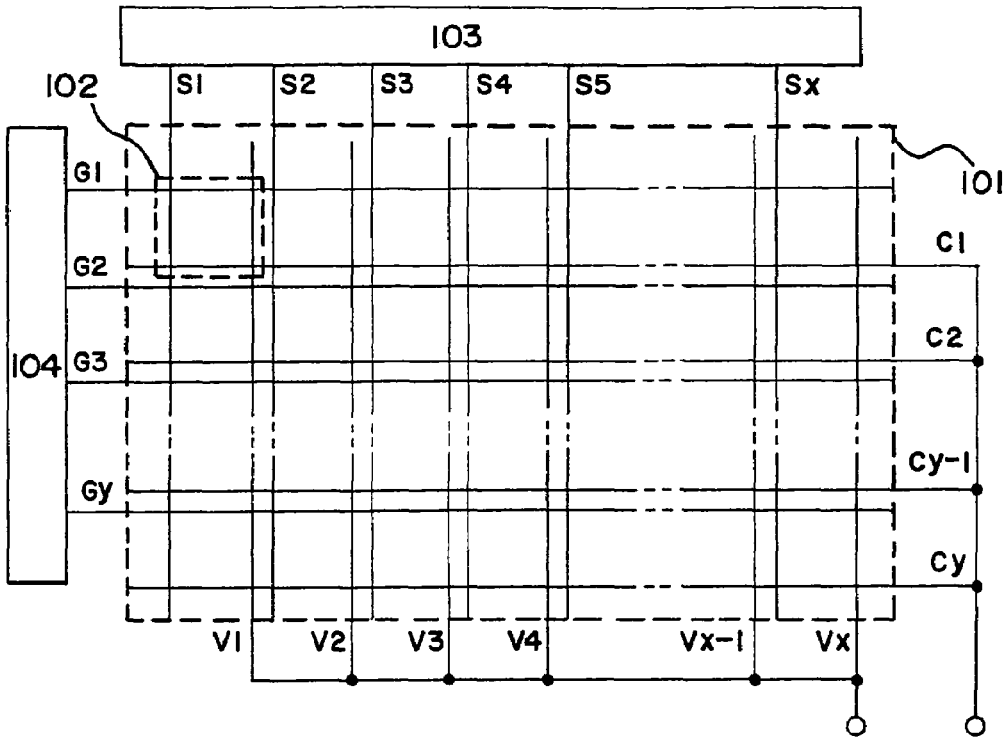
FIGS. 1A and 1B are a block diagram of a light emitting device of the present invention and a circuit diagram of a pixel.
Figure 1B:
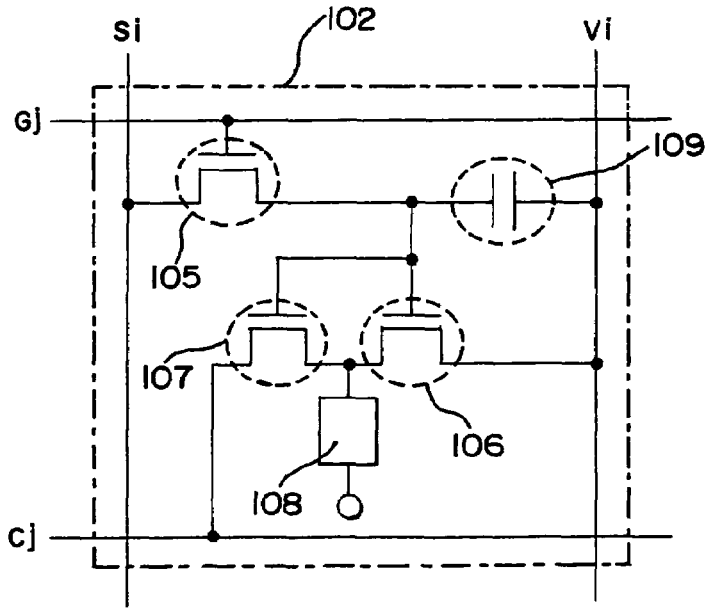

FIG. 1A is a block diagram showing a structure of an OLED in a light emitting device of the present invention and FIG. 1B is a block diagram thereof. Reference numeral 101 denotes a pixel portion. In the pixel portion 101, a plurality of pixels 102 are formed in a matrix. Also, reference numeral 103 denotes a signal line driver circuit and 104 denotes a scan line driver circuit.

Note that, in FIG. 1A, the signal line driver circuit 103 and the scan line driver circuit 104 are formed together with the pixel portion 101 on the same substrate. However, the present invention is not limited to such a structure. The signal line driver circuit 103 and the scan line driver circuit 104 may be formed on a substrate different from a substrate on which the pixel portion 101 is formed, and they may be connected with the pixel portion 101 through a connector such as an FPC. Note that the single signal line driver circuit 103 and the single scan line driver circuit 104 are provided in FIG. 1A. However, the present invention is not limited to such a structure. The number of signal line driver circuits 103 and the number of scan line driver circuits 104 can be arbitrarily set by a designer.

Also, in FIG. 1A, signal lines S1 to Sx, power source lines V1 to Vx, scan lines G1 to Gy, and discharge lines C1 to Cy are provided in the pixel portion 101. Note that the number of signal lines is not necessarily equal to the number of power source lines. Also, the number of scan lines is not necessarily equal to the number of discharge lines.

The power source lines V1 to Vx are kept at a predetermined potential. Also, the discharge lines C1 to Cy are kept at a constant potential. Note that the structure of the light emitting device for displaying a monochrome image is shown in FIG. 1A. However, the present invention may be applied to a light emitting device for displaying a color image. In this case, all the power source lines V1 to Vx are not necessarily kept at the same potential; the potential may be changed according to colors to be displayed.

FIG. 1B shows a detail structure of respective pixels. In the light emitting device of the present invention, a pixel 102 includes a least one signal line, at least one scan line, at least one power source line, and at least one discharge line. The pixel shown in FIG. 1B includes a signal line Si (i=1 to x), a scan line Gj (j=1 to y), a power source line Vi, and a discharge line Cj.

Further, according to the present invention, the pixel 102 includes at least a switching TFT 105, a driver TFT 106, a discharging TFT 107 and an OLED 108. Note that, although a storage capacitor 109 is provided in FIG. 1B to keep a potential of the gate electrode of the driver TFT 106, it is not necessarily provided. The storage capacitor may be provided as occasion demands.

Note that the switching TFT 105, the driver TFT 106, and the discharging TFT 107 are not limited to a single gate structure. These TFTs may have a multi-gate structure such as a double gate structure or a triple gate structure.

As shown in FIG. 1B, the gate electrode of the switching TFT 105 is connected with the scan line Gj. With respect to the source region and the drain region of the switching TFT 105, one is connected with the signal line Si and the other is connected with the gate electrode of the driver TFT 106.

With respect to the source region and the drain region of the driver TFT 106, one is connected with the power source line Vi and the other is connected with the pixel electrode of the OLED 108. On the other hand, the gate electrode of the discharging TFT 107 is connected with the gate electrode of the driver TFT 106. With respect to the source region and the drain region of the discharging TFT 107, one is connected with the pixel electrode of the OLED 108 and the other is connected with the discharge line Cj.

The storage capacitor 109 is formed between the gate electrode of the driver TFT 106 and the power source line Vi.

The OLED 108 includes an anode and a cathode. In this specification, when the anode is used as the pixel electrode (first electrode), the cathode is called a counter electrode (second electrode). On the other hand, when the cathode is used as the pixel electrode, the anode is called the counter electrode.

Note that the switching TFT 105 may be either an n-channel TFT or a p-channel TFT. With respect to the driver TFT 106 and the discharging TFT 107, one is an n-channel TFT and the other is a p-channel TFT. Note that, when the anode of the OLED 108 is used as the pixel electrode, the driver TFT 106 is desirably a p-channel TFT. On the other hand, when the cathode is used as the pixel electrode, the driver TFT 106 is desirably an n-channel TFT.

According to the pixel shown in FIG. 1B, a potential of the scan line Gj is controlled by the scan line driver circuit 104. A video signal is inputted to the signal line Si by the signal line driver circuit 103. When the switching TFT 105 is turned on, the video signal inputted to the signal line Si is inputted to the gate electrode of the driver TFT 106 and the gate electrode of the discharging TFT 107, through the switching TFT 105.

The operations of the driver TFT 106 and the discharging TFT 107 are controlled by a potential of the video signal inputted to the gate electrodes thereof. Hereinafter, the operations thereof will be described in detail. Note that, for ease of description, an example in which the driver TFT 106 is a p-channel TFT and the discharging TFT 107 is an n-channel TFT will be described. However, the following description applies even in the case where the driver TFT 106 is an n-channel TFT and the discharging TFT 107 is a p-channel TFT.

Figure 2A:
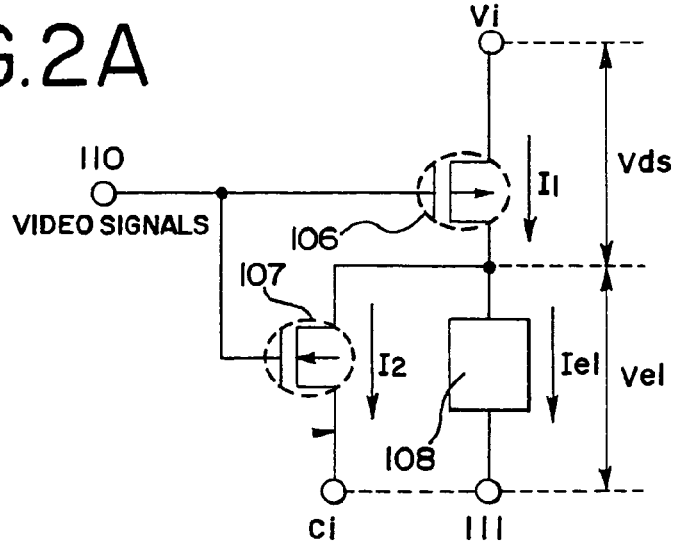
FIGS. 2A to 2C show a simplified structure of the pixel in the light emitting device of the present invention and voltage-current characteristics of elements.

FIG. 2A is a simplified diagram indicating a connection state among the driver TFT 106, the discharging TFT 107, and the OLED 108. A video signal is inputted from a terminal 110. A predetermined potential is applied from a terminal 111 to a counter electrode. Note that reference symbol $I_1$ denotes a drain current of the driver TFT 106, $I_2$ denotes a drain current of the discharging TFT 107, and Iel denotes an OLED drive current flowing into the OLED 108. Also, reference symbol Vds denotes a voltage between the source region and the drain region of the driver TFT 106 and Vel denotes a voltage between the pixel electrode and the counter electrode in the OLED 108 (OLED drive voltage).

When the driver TFT 106 is turned on, potentials of the power source line Vi and the terminal 111 are kept at a level such that the current Iel flowing into the OLED 108 becomes a forward bias. Also, when a potential of the terminal 111 is lower than that of the power source line Vi, a potential of the discharge line Ci is set to be lower than that of the power source line Vi. On the other hand, when a potential of the terminal 111 is higher than that of the power source line Vi, a potential of the discharge line Ci is set to be higher than that of the power source line Vi.

Note that, for ease of description, in this embodiment mode it is assumed that a potential of the terminal 111 is lower than that of the power source line Vi and a potential of the discharge line Ci is kept to be equal to the potential of the terminal 111. Thus, in FIG. 2A, a voltage between the source region and the drain region of the discharging TFT 107 is kept to be the same voltage as the OLED drive voltage Vel.

Figure 2B:
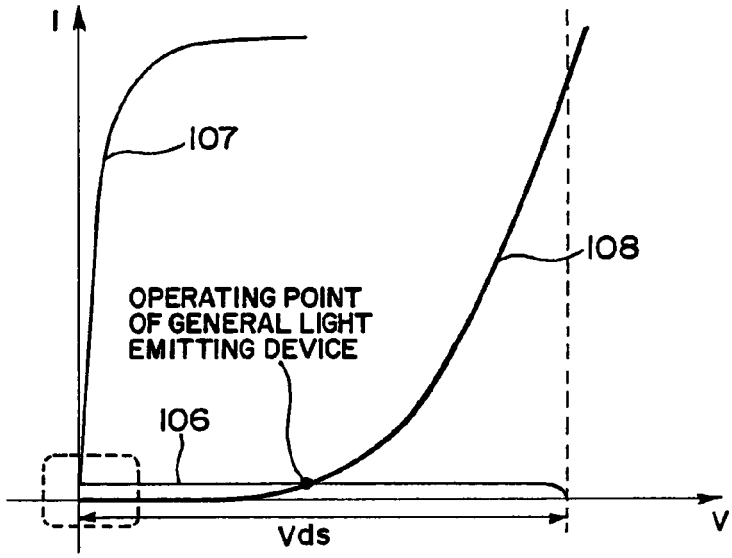
Figure 2C:
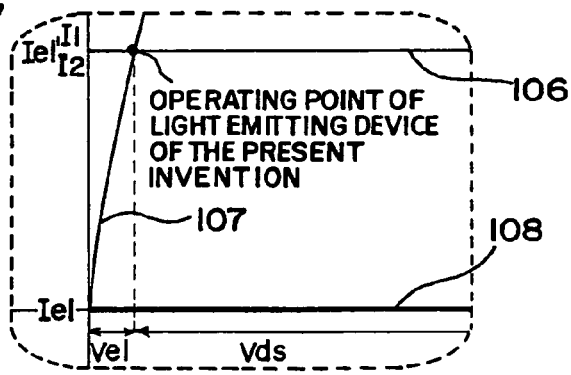

First, FIG. 2B shows voltage-current characteristics of the driver TFT 106, the discharging TFT 107, and the OLED 108 in the case where a video signal has a sufficiently high potential and a gate voltage of the driver TFT 106 is sufficiently larger than a threshold value. Also, FIG. 2C is a magnified graph of a portion surrounded by a dot line in FIG. 2B. Note that abscissa indicates a voltage between the power source line Vi and the terminal 111. Ordinate indicates a current flowing into respective elements.

When the gate voltage is sufficiently larger than a threshold value, the driver TFT 106 as a p-channel TFT becomes an off state if it is an ideal element. However, in many cases, a small amount of drain current is actually flowing. Thus, as shown in FIGS. 2B and 2C, it is considered that, although the drain current $I_1$ in the driver TFT 106 becomes small as compared with that in an on state, it does not become zero.

On the other hand, when the video signal has a sufficiently high potential, since a gate voltage of the discharging TFT 107 as an n-channel TFT becomes sufficiently larger than the threshold value, the discharging TFT 107 becomes an on state. Thus, as shown in FIGS. 2B and 2C, a value of a drain current $I_2$ relative to a voltage between the source region and the drain region in the discharging TFT 107 becomes large as compared with that in an off state. In other words, a voltage value between the source region and the drain region relative to a drain current value becomes small as compared with that in an off state.

At this time, as described above, since the driver TFT 106 is in an off state, the drain current $I_1$ is small as compared with that in an on state. Also, the drain current $I_1$ of the driver TFT 106 (off current in this case) always satisfies $I_1=I_2+Iel$; therefore, $I_2$ never becomes larger than $I_1$. Thus, the drain current $I_2$ is equal to or smaller than $I_1$. Here, as described above, as compared with that in an off state, a voltage value between the source region and the drain region relative to a drain current value in the discharging TFT 107 is small and a voltage between the source region and the drain region of the discharging TFT 107 is equal to Vel. Thus, Vel becomes very small, to the extent that almost no current flows into the OLED. Therefore, as shown in FIGS. 2B and 2C, Iel≅0 and $I_1 \cong I_2$. In other words, a cross point between the graph of the voltage-current characteristic of the discharging TFT 107 and the graph of the voltage-current characteristic of the driver TFT 106 becomes an operating point. As a result, the OLED 108 does not emit light.

Figure 15:
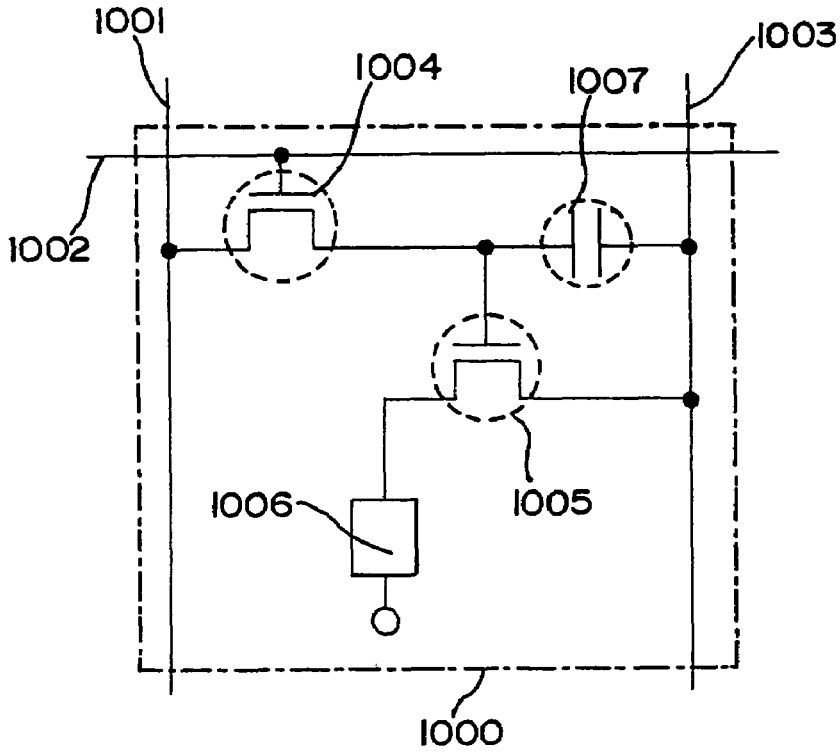
FIG.15 (PRIOR ART)
FIG. 15 is a circuit diagram of a pixel in a general light emitting device.
Figure 16:
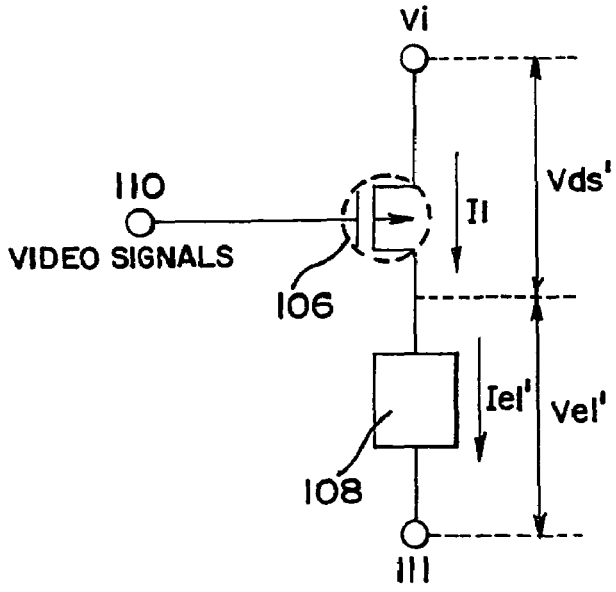
FIG.16 (PRIOR ART)
FIG. 16 shows a simplified structure of the pixel in the general light emitting device.

Note that a simplified connection state between the driver TFT 1005 and the OLED 1006 in the general light emitting device shown in FIG. 15 is shown in FIG. 16. Note that, in order to make the comparison with the present invention clearer, the same reference symbols as used in FIG. 2A are used in FIG. 16 for the terminal 110 to which a video signal is inputted and the terminal 111 for providing the counter electrode with a predetermined potential. Also, in order to make the comparison with the present invention clearer, it is assumed that the driver TFT 1005 and the OLED 1006 shown in FIG. 15 correspond to the driver TFT 106 and the OLED 108 shown in FIG. 2A.

Reference symbol $I_1$ denotes a drain current of the driver TFT 106 and Iel' denotes an OLED drive current flowing into the OLED 108. Also, reference symbol Vds denotes a voltage between the source region and the drain region of the driver TFT 106 and Vel' denotes a voltage between the pixel electrode and the counter electrode in the OLED 108 (OLED drive voltage).

In the general light emitting device, a cross point between the graph of the voltage-current characteristic of the OLED and the graph of the voltage-current characteristic of the driver TFT becomes an operating point. Thus, as shown in FIGS. 2B and 2C, a current flowing into the OLED in the general structure corresponds to the current Iel' at the operating point.

Figure 3A:
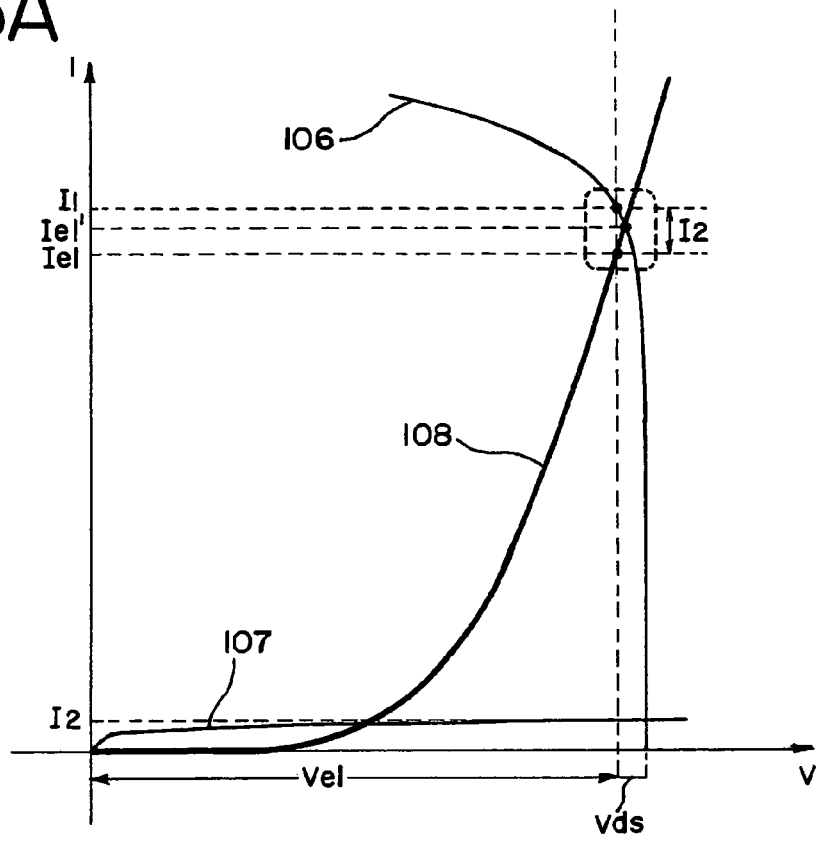
FIGS. 3A and 3B show voltage-current characteristics of the elements in the light emitting device of the present invention.
Figure 3B:
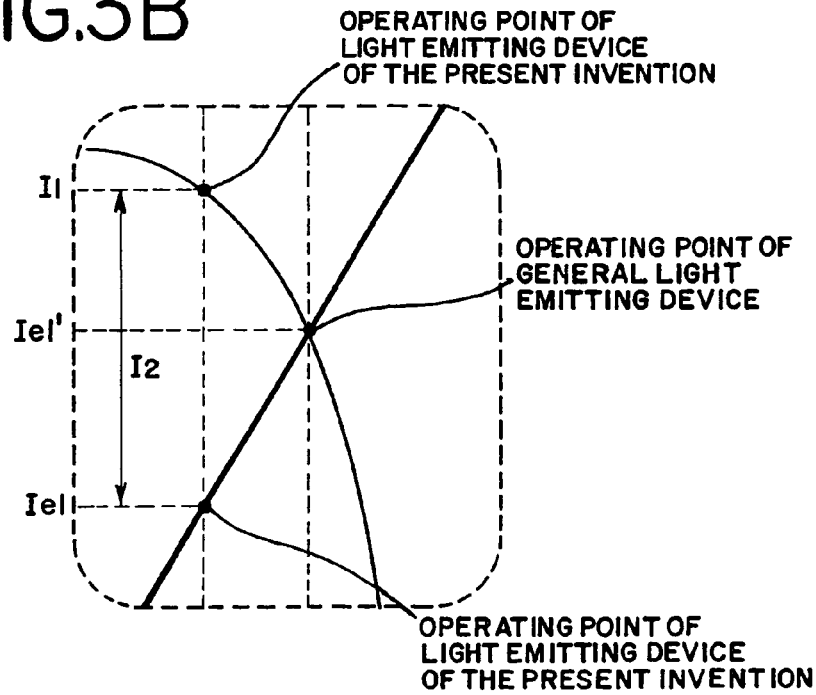

Next, FIG. 3A shows voltage-current characteristics of the driver TFT 106, the discharging TFT 107, and the OLED 108 in the case where a video signal has a sufficiently low potential and a gate voltage of the driver TFT 106 is sufficiently smaller than a threshold value. Also, FIG. 3B is a magnified view of a portion surrounded by a dot line in FIG. 3A. Note that abscissa indicates a voltage between the power source line Vi and the terminal 111. Ordinate indicates a current flowing into respective elements.

When the gate voltage is sufficiently smaller than a threshold value, the driver TFT 106 as a p-channel TFT becomes an on state if it is an ideal element. Thus, as shown in FIGS. 3A and 3B, a drain current value relative to a voltage between the source region and the drain region is large in the case of the driver TFT 106.

On the other hand, in the case of the discharging TFT 107 as an n-channel TFT, when the video signal has a sufficiently low potential, since the gate voltage becomes sufficiently smaller than the threshold value, the discharging TFT 107 becomes an off state. However, in many cases, a small amount of off current is actually produced. Thus, as shown in FIGS. 3A and 3B, it is considered that in the case of the discharging TFT 107, although a drain current value is small relative to a voltage between the source region and the drain region, it does not become zero.

The drain current $I_1$ of the driver TFT 106 always satisfies the relationship $I_1=I_2+Iel$. Thus, $Iel=I_1-I_2$ and Iel becomes equal to a value obtained by subtracting the drain current $I_2$ of the discharging TFT 107 (off current in this case) from the drain current $I_1$ of the driver TFT 106.

In the case of the general structure in which the discharging TFT 107 is not provided, since $I_2=0$, it inevitably follows that $I_1=Iel'$. However, according to the present invention, since the discharging TFT 107 is provided, Iel becomes smaller by $I_2$. When Iel becomes small, Vel also become small. Since Vel+Vds is always constant, Vds becomes large as compared with the case of the general structure. Thus, the drain current $I_1$ of the driver TFT 106 becomes larger than a drain current of the driver TFT 106 in the general structure. Therefore, when the discharging TFT 107 is provided, Iel satisfies the relationship $(Iel'-I_2)<Iel<Iel'$. In other words, since Iel becomes larger than a value obtained by simply subtracting the drain current $I_2$ of the discharging TFT 107 from the OLED current Iel' in the general structure, a difference between Iel' and Iel is small and influences on brightness becomes accordingly small.

Thus, as can be seen from FIGS. 2B, 2C, 3A, and 3B, according to the light emitting device of the present invention, even if an off current flows into the driver TFT 106, the off current is made to flow into the discharge line through the discharging TFT 107. Thus, almost no current flows into the OLED 108. Therefore, light emission of the OLED 108 is prevented, a reduction in a contrast is suppressed, and disturbance of a displayed image can be prevented.

Next, a relationship between the driver TFT 106 and the OLED drive current Iel in the light emitting device of the present invention will be described.

Figure 4A:
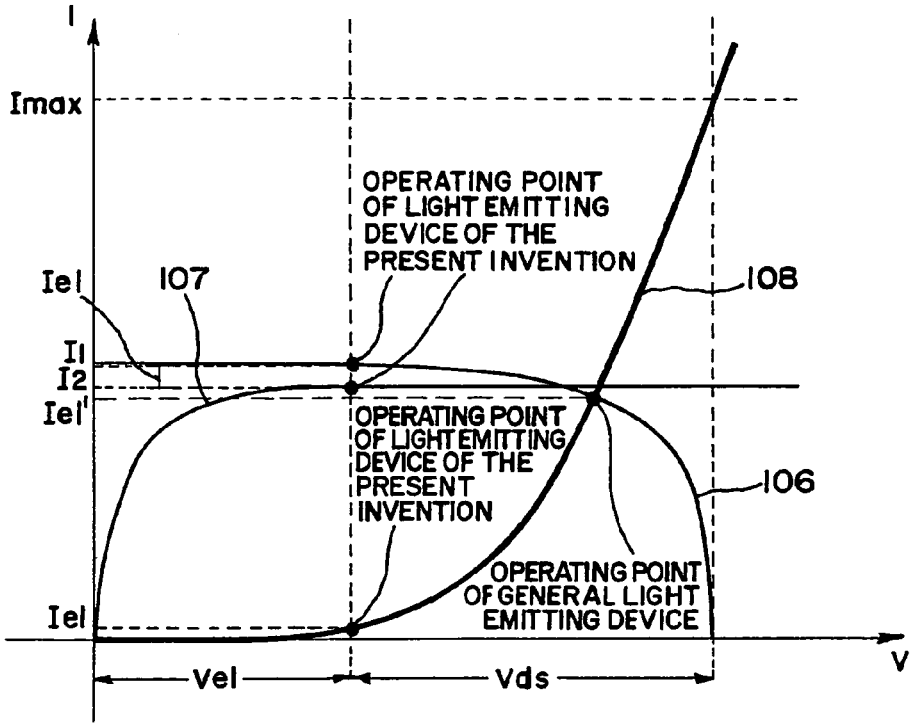
FIGS. 4A and 4B show voltage-current characteristics of the elements in the light emitting device of the present invention.

FIG. 4A shows voltage-current characteristics of the driver TFT 106, the discharging TFT 107, and the OLED 108 in the case when a gate voltage of the driver TFT 106 becomes somewhat smaller than a threshold value and a drain current thereof starts to increase. Note that abscissa indicates a voltage between the power source line Vi and the terminal 111. Ordinate indicates a current flowing into respective elements.

The driver TFT 106, the discharging TFT 107, and the OLED 108 are operated such that the relationship $I_1=I_2+Iel$ is always satisfied. Thus, a value of Iel is determined such that the relationship $I_1=I_2+Iel$ is satisfied in FIG. 4A.

On the other hand, in the case of the general light emitting device, the relationship $I_1=I_2$ is satisfied. Thus, a cross point between the graph of the driver TFT 106 and the graph of the OLED 108 is an operating point and a current at the operating point corresponds to Iel'.

When Iel in the light emitting device of the present invention is compared with the OLED drive current Iel' in the general light emitting device in FIG. 4A, Iel' is larger than Iel. This is because a gate voltage of the discharging TFT 107 is not sufficiently smaller than a threshold value and thus the drain current $I_2$ of the discharging TFT 107 becomes so large that it can no longer be neglected. Thus, at the point in time when the gate voltage of the driver TFT 106 has become somewhat smaller than the threshold value, the luminance of the OLED in the light emitting device of the present invention is presumably small as compared with that in the general light emitting device.

Figure 4B:
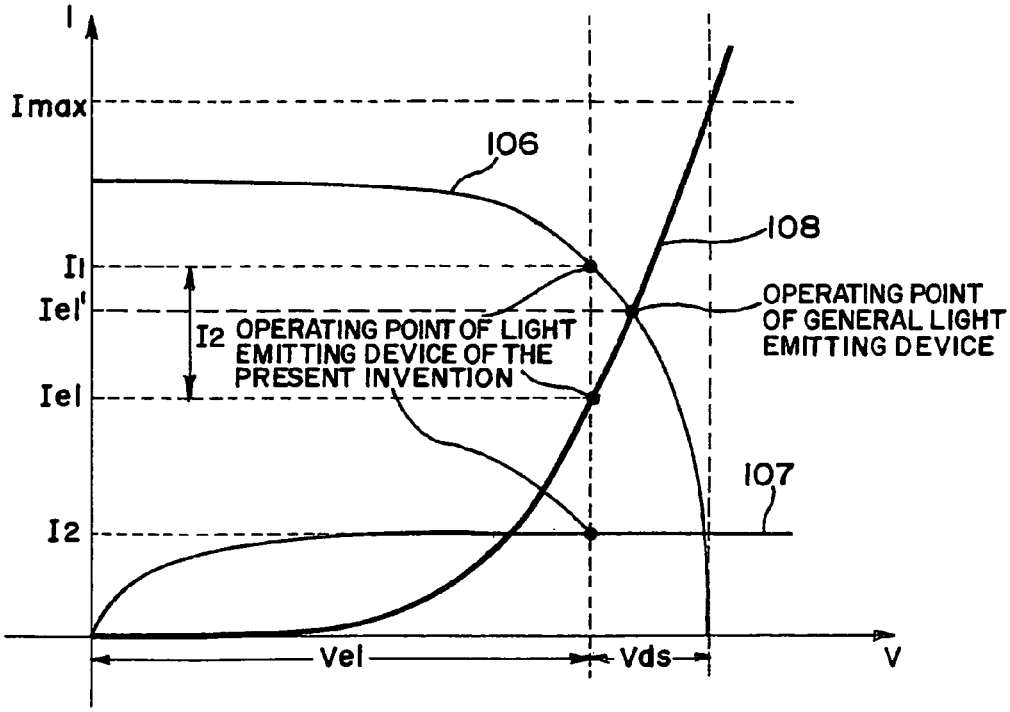

Next, FIG. 4B shows voltage-current characteristics of the driver TFT 106, the discharging TFT 107, and the OLED 108 in the case when a gate voltage of the driver TFT 106 is further lowered than that in the state of FIG. 4A. Note that abscissa indicates a voltage between the power source line Vi and the terminal 111. Ordinate indicates a current flowing into respective elements.

The driver TFT 106, the discharging TFT 107, and the OLED 108 are operated such that the relationship $I_1=I_2+Iel$ is always satisfied. Thus, a value of Iel is determined such that the relationship $I_1=I_2+Iel$ is satisfied in FIG. 4B.

On the other hand, in the case of the general light emitting device, the relationship $I_1=I_2$ is satisfied. Thus, a cross point between the graph of the driver TFT 106 and the graph of the OLED 108 is an operating point, and a current at the operating point corresponds to Iel'.

As can be seen from FIG. 4B, a difference between Iel in the light emitting device of the present invention and Iel' in the general light emitting device becomes smaller than in the case of FIG. 4A. This is because the drain current $I_2$ of the discharging TFT 107 is decreased as the gate voltage thereof becomes smaller. As a potential of a video signal inputted to the terminal 110 becomes lower and the gate voltage of the discharging TFT 107 becomes smaller, $I_2$ becomes smaller. Then, as shown in FIGS. 3A and 3B, Iel becomes closer to Iel' as much as possible.

Figure 5:
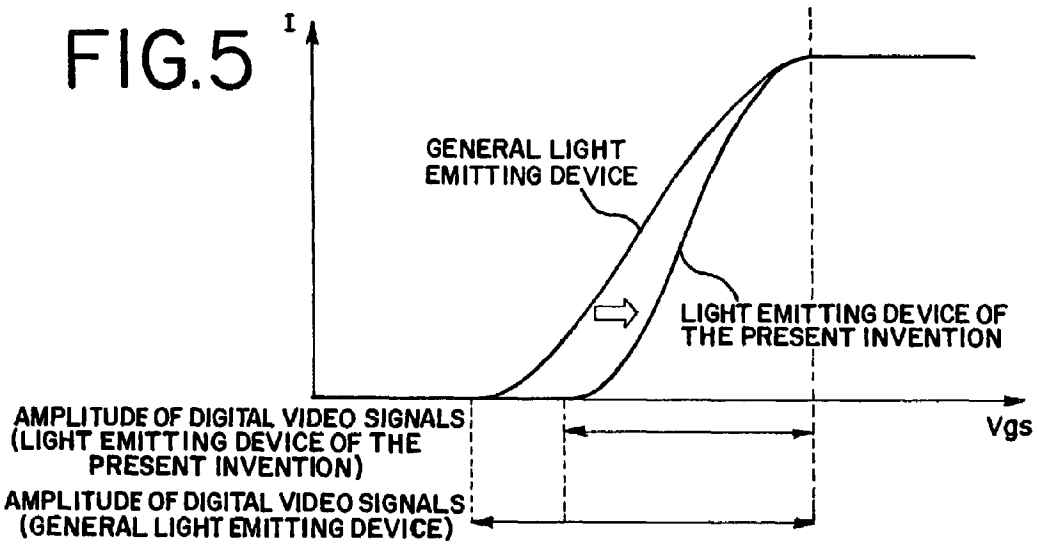
FIG. 5 shows a voltage-current characteristic of a driver TFT in the light emitting device of the present invention.

As can be seen from FIGS. 4A and 4B, a relationship between a gate voltage Vgs of the driver TFT 106 and the current Iel flowing into the OLED 108 is obtained as a graph shown in FIG. 5. Note that a relationship between a gate voltage Vgs of the driver TFT 106 and the current Iel' flowing into the OLED 108 in the general light emitting device is also indicated for comparison.

As can be seen from FIG. 5, according to the light emitting device of the present invention, the gradient of the graph becomes steep as compared with the general light emitting device without that does not use a discharging TFT. Thus, the amplitude of a digital video signal can be decreased as compared with the case where the discharging TFT is not used. In the case of drive according to digital gradation system for performing gradation display using a digital video signal, a power source voltage of the signal line driver circuit for controlling input of the digital video signal to the signal line can be decreased as the amplitude of the signal becomes smaller. Thus, according to the light emitting device of the present invention, the power consumption of the signal line driver circuit can be suppressed in the case of the drive according to the digital gradation system.

Also, in the case of a general pixel shown in FIG. 15, when the driver TFT is turned off after light emission of an organic light emitting element is performed, a voltage between two electrodes of the organic light emitting element is reduced due to free discharge. At this time, when the voltage between two electrodes of the organic light emitting element becomes a threshold value or lower, a resistance between the two electrodes is increased exponentially and the discharge becomes very slow. Thus, even after the driver TFT is turned off, a state in which the organic light emitting element emits dim light is sustained for a relatively long time. However, according to the light emitting device of the present invention, when the driver TFT is turned off, the discharging TFT is turned on. Thus, a charge can be forcedly drawn out and afterglow can be prevented.

Hereinafter, embodiments of the present invention will be described.

Embodiment 1

Figure 6:
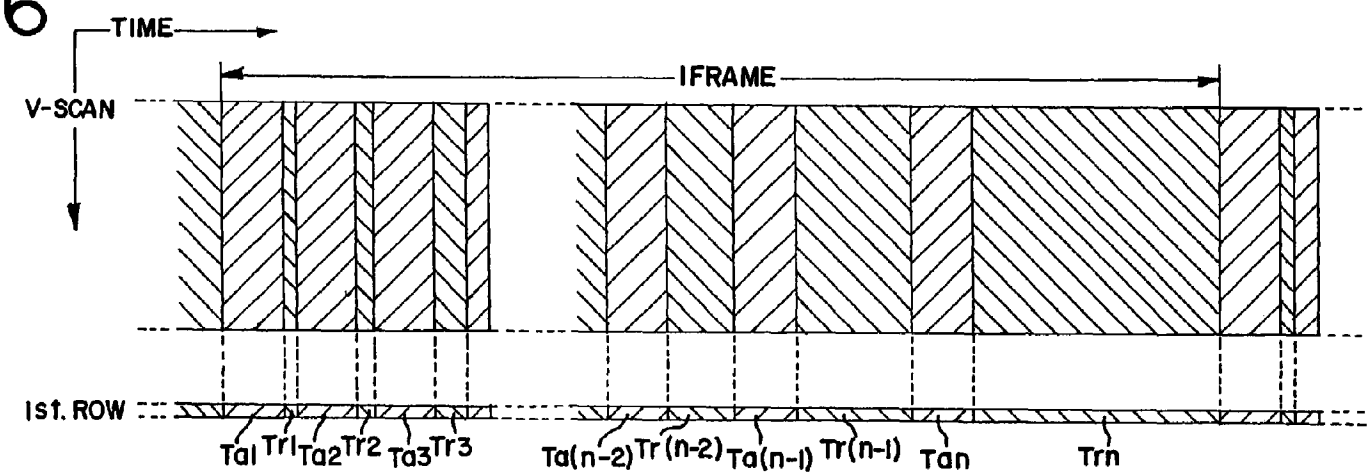
FIG. 6 shows a method of driving the light emitting device of the present invention.

In this embodiment, the case where the light emitting device of the present invention as shown in FIGS. 1A and 1B is driven by a digital gradation system will be described using FIG. 6.

First, a potential of the counter electrode of the OLED is kept to be the same potential as a power source potential of the power source line. Then, the scan line G1 is selected by a selection signal inputted from the scan line driver circuit 104. As a result, the switching TFTs 105 of all pixels (pixels in the first line) connected with the scan line G1 become an on state.

Then, digital video signals of a first bit are inputted from the signal line driver circuit 103 to the signal lines (S1 to Sx). The digital video signals are inputted to the gate electrodes of the driver TFTs 106 and the gate electrodes of the discharging TFTs 107 through the switching TFT 105s.

Switchings of the driver TFTs 106 and the discharging TFTs 107 are controlled by information indicating 1 or 0, which is contained in the digital video signals. For example, when the driver TFTs 106 are turned on, the discharging TFTs 107 are turned off. On the other hand, when the driver TFTs 106 are turned off, the discharging TFTs 107 are turned on.

Next, the selection of the scan line G1 is completed, and then the scan line G2 is similarly selected by a selection signal. Then, the switching TFTs 105 of all pixels connected with the scan line G2 become an on state, and digital video signals of a first bit are inputted from the signal lines (S1 to Sx) to the pixels in a second line. Note that in this specification, input of a digital video signal to a pixel means that the digital video signal is inputted to the gate electrode of the driver TFT 106 and the gate electrode of the discharging TFT 107 in the pixel. Then, switchings of the driver TFTs 106 and the discharging TFTs 107 of the pixels in the second line are controlled by the digital video signals as in the case of the pixels in the first line.

Then, all the remaining scan lines (G3 to Gx) are selected by selection signals in order. A period until all scan lines (G1 to Gx) are selected and the digital video signals of a first bit are inputted to the pixels in all lines is a write period Ta1.

After the write period Tai is elapsed, a display period Tri comes next. During the display period Tri, the counter electrode has a potential such that a difference in potential is produced between it and power source potentials of the power source lines, to the degree that the OLEDs 108 emit light when the power source potentials are applied to the pixel electrodes of the OLEDs.

When the driver TFTs 106 are in an on state due to the digital video signals inputted to the pixels during the write period, the power source potentials are applied to the pixel electrodes of the OLEDs 108. As a result, the OLEDs 108 emit light. At this time, the discharging TFTs 107 are an off state.

On the other hand, when the driver TFTs 106 are in an off state due to the digital video signals inputted to the pixels during the write period, the power source potentials are not applied to the pixel electrodes of the OLEDs 108. As a result, the OLEDs 108 do not emit light. At this time, the discharging TFTs 107 are an on state. Thus, even if an off current flows into the driver TFTs 106, since it almost entirely flows into the discharge lines, the OLEDs 108 do not emit light.

Thus, during the display period Tr1, the OLEDs 108 become a light emission state or a non-light emission state and all pixels perform a display. A period for which a display is performed by the pixels is called a display period Tr. In particular, a period for which a display is performed by means of the digital video signals of the first bit is called a display period Tr1. For ease of description, only a display period for the pixels in the first line is particularly shown in FIG. 6. Display periods in all lines are started at the same timing.

After the display period Tr1 is elapsed, a write period Ta2 comes next and a potential of the counter electrode of the OLED becomes the same potential as the power potential of the power source lines. Then, as in the case of the write period Ta1, all scan lines are selected in order and digital video signals of a second bit are inputted to all pixels. A period until inputs of the digital video signals of the second bit to the pixels in all lines are completed is called a write period Ta2.

After the write period Ta2 ends, a display period Tr2 comes next. Thus, potential differences are produced between the counter electrode and the power source lines and display is performed in all pixels.

The above operations are repeated until digital video signals of an nth bit are inputted to pixels, and the write period Ta and the display period Tr repeatedly appear. When all display periods (Tr1 to Trn) are elapsed, one image can be displayed. In the drive method of this embodiment, a period for displaying one image is called one frame period (F). After one frame period is elapsed, next frame period is started. Then, the write period Tai appears again and the above, operations are repeated.

In the case of the general light emitting device, it is preferable that 60 or more frame periods are provided per 1 second. If the number of images to be displayed during 1 second becomes smaller than 60, flicker of a visual image may start to become noticeable.

In this embodiment, it is required that the sum of all write periods is set to be shorter than one frame period and a ratio among display periods is set to be Tr1: Tr2: Tr3: . . . : Tr(n−1): Trn=$2^0$: $2^1$: $2^2$: . . . . : $2^{(n-2)}$: $2^{(n-1)}$. Display with a desired gradation of up to a $2^n$ gradation can be made by a combination of the display periods.

When the sum of display periods for which the OLEDs emit light during one frame period is obtained, a gradation displayed by the pixel during the frame period is determined. For example, when n=8, if a brightness obtained when light emission is produced in the pixel during all display periods is assumed to be 100%, when the element emits light during the display periods Tr1 and Tr2, a brightness of 1% can be attained. When the display periods Tr3, Tr5, and Tr8 are selected, a brightness of 60% can be attained.

Also, the display periods Tr1 to Trn may appear in any order. For example, during one frame period, the display periods may appear in an order such that Tr3, Tr5, Tr2, . . . appear after Tr1.

Note that a potential of the counter electrode is changed between a write period and a display period in this embodiment. However, the present invention is not limited to this. A difference of potential may be made to always exist between the power source lines and the counter electrode. In this case, light emission of the OLED becomes possible even during the write period. Thus, a gradation displayed by the pixel during the frame period is determined by the sum of the write periods and the display periods in which the OLED emits light during one frame period. Note that, in this case, it is required that ratios among the sum of the write period and the display period corresponding to a digital video signal of each bit is set to be (Ta1+Tr1): (Ta2+Tr2): (Ta3+Tr3): . . . : (Ta(n−1)+Tr(n−1)): (Tan+Trn)=$2^0$: $2^1$: $2^2$: . . . : $2^{(n-2)}$: $2^{(n-1)}$.

Embodiment 2

A structure of a pixel in the light emitting device of the present invention is not limited to the structure shown in FIG. 1B. In this embodiment, an example of a structure of a pixel in the light emitting device of the present invention, which is different from the structure shown in FIG. 1B, will be described. FIGS. 7A, 7B, 17A, and 17B show structures of a pixel in this embodiment.

Figure 7A:
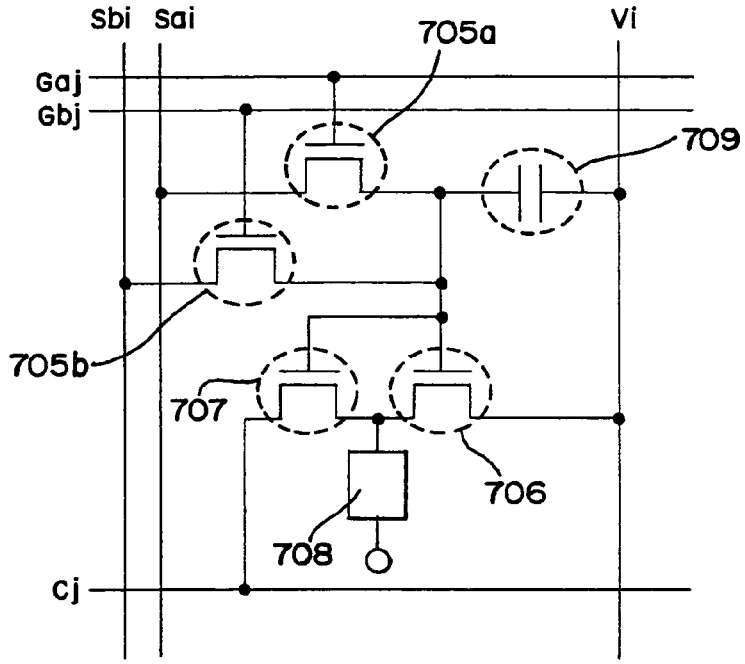
FIGS. 7A and 7B are circuit diagrams of pixels in the light emitting device of the present invention.

A pixel shown in FIG. 7A includes at least one first signal line Sai, at least one second signal line Sbi, at least one first scan line Gaj, at least one second scan line Gbj, at least one power source line Vi, and at least one discharge line Cj.

Also, the pixel shown in FIG. 7A further includes a first switching TFT 705*a*, a second switching TFT 705*b*, a driver TFT 706, a discharging TFT 707, an OLED 708, and a storage capacitor 709.

Next, the connection among respective elements and wirings in the pixel shown in FIG. 7A will be described in more detail.

The gate electrode of the first switching TFT 705*a* is connected with the first scan line Gaj. Also, with respect to the source region and the drain region of the first switching TFT 705*a*, one is connected with the first signal line Sai and the other is connected with the gate electrode of the driver TFT 706.

The gate electrode of the second switching TFT 705*b* is connected with the second scan line Gbj. Also, with respect to the source region and the drain region of the second switching TFT 705*b*, one is connected with the second signal line Sbi and the other is connected with the gate electrode of the driver TFT 706.

The gate electrode of the discharging TFT 707 is connected with the gate electrode of the driver TFT 706. Also, with respect to the source region and the drain region of the discharging TFT 707, one is connected with the discharge line Cj and the other is connected with the pixel electrode of the OLED 708.

With respect to the source region and the drain region of the driver TFT 706, one is connected with the power source line Vi and the other is connected with the pixel electrode of the OLED 708. A difference of potential is always produced between the power source line Vi and the counter electrode of the OLED 708.

The storage capacitor 709 is formed between the power source line Vi and the gate electrode of the driver TFT 706.

When the first scan line Gaj is selected by a selection signal, the first switching TFT 705*a* is turned on. Then, a digital video signal inputted to the first signal line is inputted to the gate electrode of the driver TFT 706 and the gate electrode of the discharging TFT 707 to thereby perform a display in the pixel.

After that, when the second scan line Gbj is selected by a selection signal, the second switching TFT 705*b* is turned on. Then, a digital video signal inputted to the second signal line is inputted to the gate electrode of the driver TFT 706 and the gate electrode of the discharging TFT 707 to thereby perform a display in the pixel.

When, by means of digital video signals of all bits, display is performed in all pixels, one image is displayed.

In the case of the pixel shown in FIG. 7A, the display period can be set to be shorter than the write period. Thus, even if the number of bits of a digital video signal is increased as the number of gradations becomes larger, an image can be displayed without decreasing a frame frequency.

Figure 7B:
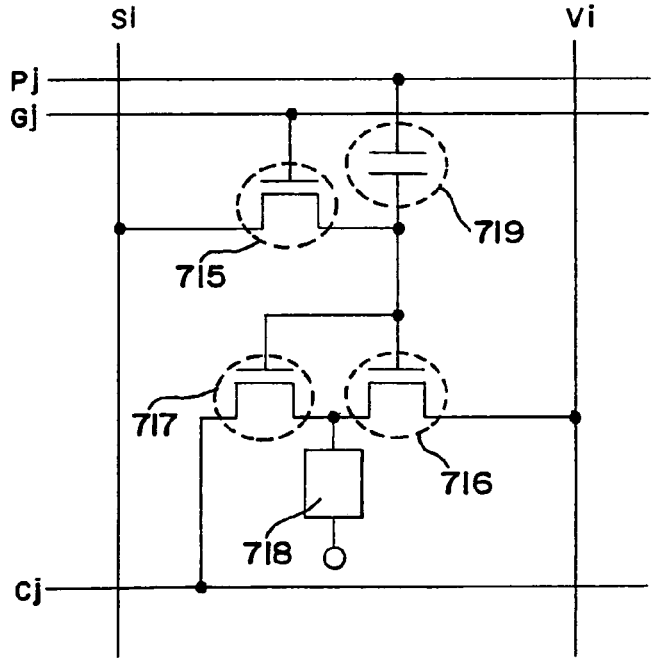

A pixel shown in FIG. 7B includes at least one signal line Si, at least one scan line Gj, at least one power source line Vi, at least one discharge line Cj, and at least one capacitor line Pj.

Also, the pixel shown in FIG. 7B further includes a switching TFT 715, a driver TFT 716, a discharging TFT 717, an OLED 718, and a storage capacitor 719.

Next, the connection among respective elements and wirings in the pixel shown in FIG. 7B will be described in more detail.

The gate electrode of the switching TFT 715 is connected with the scan line Gj. Also, with respect to the source region and the drain region of the switching TFT 715, one is connected with the signal line Si and the other is connected with the gate electrode of the driver TFT 716.

The gate electrode of the discharging TFT 717 is connected with the gate electrode of the driver TFT 716. Also, with respect to the source region and the drain region of the discharging TFT 717, one is connected with the discharge line Cj and the other is connected with the pixel electrode of the OLED 718.

With respect to the source region and the drain region of the driver TFT 716, one is connected with the power source line Vi and the other is connected with the pixel electrode of the OLED 718. A difference of potential is always produced between the power source line Vi and the counter electrode of the OLED 718.

The storage capacitor 719 is formed between the capacitor line Pj and the gate electrode of the driver TFT 716. The capacitor line Pj is kept at the same potential as the power source line Vi.

When the scan line Gj is selected by a selection signal, the switching TFT 715 is turned on. Then, a digital video signal inputted to the signal line is inputted to the gate electrode of the driver TFT 716 and the gate electrode of the discharging TFT 717 to make a display in the pixel.

Next, based on the principle of conservation of charge, a gate voltage of the driver TFT 716 and a gate voltage of the discharging TFT 717 are adjusted by controlling a potential of the capacitor line Pj such that the driver TFT 716 is turned off and the discharging TFT 717 is turned on. When the driver TFT 716 is turned off, a display is not performed in the pixel, and the display period is ended forcibly.

When display is performed in all pixels by means of digital video signals of all bits, one image is displayed.

In the case of the pixel shown in FIG. 7B, the display period can be set to be shorter than the write period. Thus, even if the number of bits of a digital video signal is increased as the number of gradations becomes larger, an image can be displayed without decreasing a frame frequency.

Figure 17A:
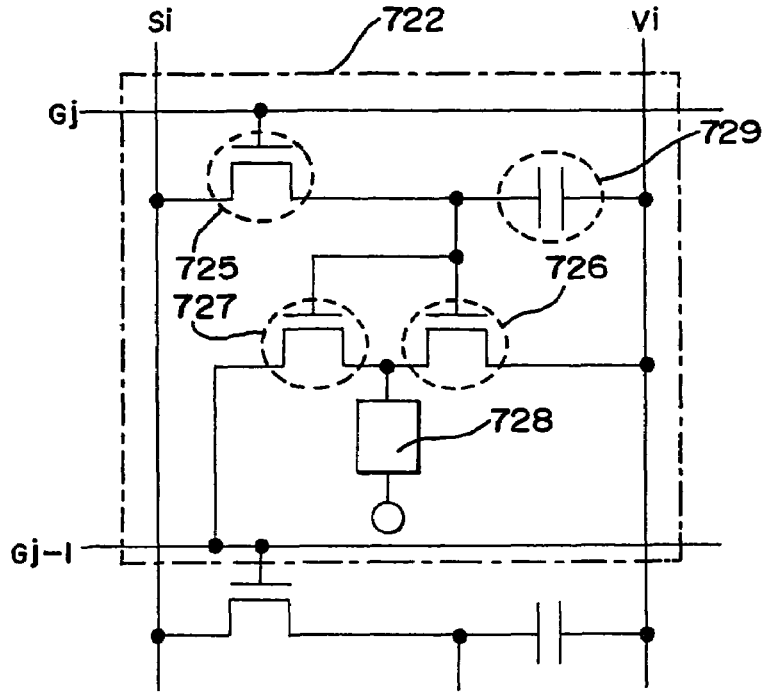
FIGS. 17A and 17B are circuit diagrams of pixels in the light emitting device of the present invention.

A pixel 722 shown in FIG. 17A includes at least one signal line Si, at least one scan line Gj, and at least one power source line Vi.

Also, the pixel shown in FIG. 17A further includes at least a switching TFT 725, a driver TFT 726, a discharging TFT 727, an OLED 728, and a storage capacitor 729.

Note that the switching TFT 725 and the discharging TFT 727 preferably have the same polarity in FIG. 17A.

Next, the connection among respective elements and wirings in the pixel shown in FIG. 17A will be described in more detail. The gate electrode of the switching TFT 725 is connected with the scan line Gj. Also, with respect to the source region and the drain region of the switching TFT 725, one is connected with the signal line Si and the other is connected with the gate electrode of the driver TFT 726.

The gate electrode of the discharging TFT 727 is connected with the gate electrode of the driver TFT 726. Also, with respect to the source region and the drain region of the discharging TFT 727, one is connected with a scan line Gj−1 and the other is connected with the pixel electrode of the OLED 728.

The scan lien Gj−1 is a scan line selected before the selection of the scan line Gj. Note that a scan line which is connected with the source region or the drain region of the discharging TFT in each pixel may be any one of scan lines in the pixel portion.

With respect to the source region and the drain region of the driver TFT 726, one is connected with the power source line Vi and the other is connected with the pixel electrode of the OLED 728. A difference of potential is always produced between the power source line Vi and the counter electrode of the OLED 728.

The storage capacitor 729 is formed between the power source line Vi and the gate electrode of the driver TFT 726.

When the scan line Gj is selected by a selection signal, the switching TFT 725 is turned on. Then, a digital video signal inputted to the signal line is inputted to the gate electrode of the driver TFT 726 and the gate electrode of the discharging TFT 727 to thereby perform a display in the pixel.

When display is performed in all pixels by means of digital video signals of all bits, one image is displayed.

Note that the scan line is used as the discharge line in the pixel shown in FIG. 17A, unlike in the case of the pixels shown in FIGS. 1B, 7A, and 7B. Thus, it is unnecessary to provide a separate discharge line and the number of wirings in the pixel portion can be thus suppressed. Therefore, when forming such a shunt circuit, it is not necessary to form a wiring that is used exclusively for flowing an off current therethrough but the scan line, the signal line, the power source line, or some other wiring can be used as the discharge line.

Figure 17B:
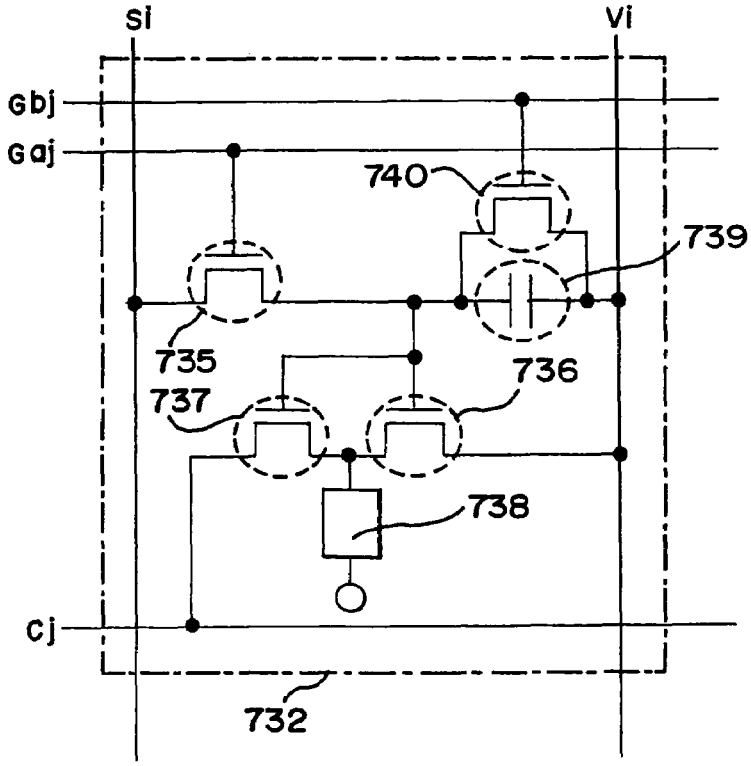

A pixel shown in FIG. 17B includes at least one signal line Si, at least one first scan line Gaj, at least one second scan line Gbj, at least one power source line Vi, and at least one discharge line Cj.

Also, the pixel shown in FIG. 17B further includes at least a switching TFT 735, an erasing TFT 740, a driver TFT 736, a discharging TFT 737, an OLED 738, and a storage capacitor 739.

Next, the connection among respective elements and wirings in the pixel shown in FIG. 17B will be described in more detail.

The gate electrode of the switching TFT 735 is connected with the first scan line Gaj. Also, with respect to the source region and the drain region of the switching TFT 735, one is connected with the signal line Si and the other is connected with the gate electrode of the driver TFT 736.

The gate electrode of the erasing TFT 740 is connected with the second scan line Gbj. Also, with respect to the source region and the drain region of the erasing TFT 740, one is connected with the power source line Vi and the other is connected with the gate electrode of the driver TFT 736.

The gate electrode of the discharging TFT 737 is connected with the gate electrode of the driver TFT 736. Also, with respect to the source region and the drain region of the discharging TFT 737, one is connected with the discharge line Cj and the other is connected with the pixel electrode of the OLED 738.

With respect to the source region and the drain region of the driver TFT 736, one is connected with the power source line Vi and the other is connected with the pixel electrode of the OLED 738. A difference of potential is always produced between the power source line Vi and the counter electrode of the OLED 738.

The storage capacitor 739 is formed between the power source line Vi and the gate electrode of the driver TFT 736.

When the first scan line Gaj is selected by a first selection signal, the switching TFT 735 is turned on. Then, a digital video signal inputted to the signal line is inputted to the gate electrode of the driver TFT 736 and the gate electrode of the discharging TFT 737 to thereby perform a display in the pixel, Next, when the second scan line Gbj is selected by a second selection signal, the erasing TFT 740 is turned on. Then, a potential of the power source line Vi is applied to the gate electrode and the source region of the driver TFT 736. Thus, the driver TFT 736 is turned off. When the driver TFT 736 is turned off, a display is no longer performed in the pixel, and the display period is forcibly ended.

When display is performed in all pixels by means of digital video signals of all bits, one image is displayed.

In the case of the pixel shown in FIG. 17B, the display period can be set to be shorter than the write period. Thus, even if the number of bits of a digital video signal is increased as the number of gradations becomes larger, an image can be displayed without decreasing a frame frequency. Note that the first scan line or the second scan line may be used as the discharge line as in the case of FIG. 17A. In this case, the number of wirings in each pixel can be reduced.

A pixel in the light emitting device of the present invention is not limited to the pixels as shown in FIGS. 1A and 1B as well as FIGS. 7A, 7B, 17A, and 17B. The power source line may not be provided and the gate signal line in another pixel may be used instead of the power source line. The light emitting device of the present invention preferably has a structure such that an off current in the driver TFT does not flow into the OLED but actively flows into a shunt circuit. More specifically, the discharge line and the pixel electrode of the OLED are preferably connected with each other through a TFT that is turned off when the driver TFT is turned on and is turned on when the driver TFT is turned off.

Embodiment 3

Next, described with reference to FIGS. 8A to 12 is a method of forming the light emitting device of the present invention. Here, the method of simultaneously forming, on the same substrate, the switching TFT and the driver TFT of the pixel portion, and the TFTs of a driver portion provided surrounding the pixel portion is described in detail according to steps. Further, the method of forming the discharge TFT is not illustrated to simplify the explanation, because the discharge TFT can be formed by reference of manufacturing method of forming the switching TFT and the driver TFT.

This embodiment uses a substrate 900 of a glass such as barium borosilicate glass or aluminoborosilicate glass as represented by the glass #7059 or the glass #1737 of Corning Co. There is no limitation on the substrate 900 provided it has a property of transmitting light, and there may be used a quartz substrate. There may be further used a plastic substrate having heat resistance capable of withstanding the treatment temperature of this embodiment.

Referring next to FIG. 8 (A), an underlying film 901 comprising an insulating film such as silicon oxide film, silicon nitride film or silicon oxynitride film is formed on the substrate 900. In this embodiment, the underlying film 901 has a two-layer structure. There, however, may be employed a structure in which a single layer or two or more layers are laminated on the insulating film. The first layer of the underlying film 901 is a silicon oxynitride film 901*a* formed maintaining a thickness of from 10 to 200 nm (preferably, from 50 to 100 nm) relying upon a plasma CVD method by using $SiH_4$, $NH_3$ and $N_2O$ as reaction gases. In this embodiment, the silicon oxynitride film 901*a* (having a composition ratio of Si=32%, O=27%, N=24%, H=17%) is formed maintaining a thickness of 50 nm. The second layer of the underlying film 901 is a silicon oxynitride film 901*b* formed maintaining a thickness of from 50 to 200 nm (preferably, from 100 to 150 nm) relying upon the plasma CVD method by using $SiH_4$ and $N_2O$ as reaction gases. In this embodiment, the silicon oxynitride film 901*b* (having a composition ratio of Si=32%, O=59%, N=7%, H=2%) is formed maintaining a thickness of 100 nm.

Then, semiconductor layers 902 to 905 are formed on the underlying film 901. The semiconductor layers 902 to 905 are formed by forming a semiconductor film having an amorphous structure by a known means (sputtering method, LPCVD method or plasma CVD method) followed by a known crystallization processing (laser crystallization method, heat crystallization method or heat crystallization method using a catalyst such as nickel), and patterning the crystalline semiconductor film thus obtained into a desired shape. The semiconductor layers 902 to 905 are formed in a thickness of from 25 to 80 nm (preferably, from 30 to 60 nm). Though there is no limitation on the material of the crystalline semiconductor film, there is preferably used silicon or a silicon-germanium ($Si_xGe_{1-x}$ (X=0.0001 to 0.02)) alloy. In this embodiment, the amorphous silicon film is formed maintaining a thickness of 55 nm relying on the plasma CVD method and, then, a solution containing nickel is held on the amorphous silicon film. The amorphous silicon film is dehydrogenated (500° C., 1 hour), heat-crystallized (550° C., 4 hours) and is, further, subjected to the laser annealing to improve the crystallization, thereby to form a crystalline silicon film. The crystalline silicon film is patterned by the photolithographic method to form semiconductor layers 902 to 905.

The semiconductor layers 902 to 905 that have been formed may further be doped with trace amounts of an impurity element (boron or phosphorus) to control the threshold value of the TFT.

In forming the crystalline semiconductor film by the laser crystallization method, further, there may be employed an excimer laser of the pulse oscillation type or of the continuously light-emitting type, a YAG laser or a $YVO_4$ laser. When these lasers are to be used, it is desired that a laser beam emitted from a laser oscillator is focused into a line through an optical system so as to fall on the semiconductor film. The conditions for crystallization are suitably selected by a person who carries out the process. When the excimer laser is used, the pulse oscillation frequency is set to be 300 Hz and the laser energy density to be from 100 to 400 mJ/cm$^2$ (typically, from 200 to 300 mJ/cm$^2$). When the YAG laser is used, the pulse oscillation frequency is set to be from 30 to 300 kHz by utilizing the second harmonics and the laser energy density to be from 300 to 600 mJ/cm$^2$ (typically, from 350 to 500 mJ/cm$^2$). The whole surface of the substrate is irradiated with the laser beam focused into a line of a width of 100 to 1000 μm, for example, 400 μm, and the overlapping ratio of the linear beam at this moment is set to be 50 to 90%.

Then, a gate insulating film 906 is formed to cover the semiconductor layers 902 to 905. The gate insulating film 906 is formed of an insulating film containing silicon maintaining a thickness of from 40 to 150 nm by the plasma CVD method or the sputtering method. In this embodiment, the gate insulating film is formed of a silicon oxynitride film (composition ratio of Si=32%, O=59%, N=7%, H=2%) maintaining a thickness of 110 nm by the plasma CVD method. The gate insulating film is not limited to the silicon oxynitride film but may have a structure on which is laminated a single layer or plural layers of an insulating film containing silicon.

When the silicon oxide film is to be formed, TEOS (tetraethyl orthosilicate) and $O_2$ are mixed together by the plasma CVD method, and are reacted together under a reaction pressure of 40 Pa, at a substrate temperature of from 300 to 400° C., at a frequency of 13.56 MHz and a discharge electric power density of from 0.5 to 0.8 W/cm$^2$. Thus formed silicon oxide film is, then, heat annealed at 400 to 500° C. thereby to obtain the gate insulating film having good properties.

Then, a heat resistant conductive layer 907 is formed on the gate insulating film 906 maintaining a thickness of from 200 to 400 nm (preferably, from 250 to 350 nm) to form the gate electrode. The heat-resistant conductive layer 907 may be formed as a single layer or may, as required, be formed in a structure of laminated layers of plural layers such as two layers or three layers. The heat resistant conductive layer contains an element selected from Ta, Ti and W, or contains an alloy of the above element, or an alloy of a combination of the above elements. The heat-resistant conductive layer is formed by the sputtering method or the CVD method, and should contain impurities at a decreased concentration to decrease the resistance and should, particularly, contain oxygen at a concentration of not higher than 30 ppm. In this embodiment, the W film is formed maintaining a thickness of 300 nm. The W film may be formed by the sputtering method by using W as a target, or may be formed by the hot CVD method by using tungsten hexafluoride ($WF_6$). In either case, it is necessary to decrease the resistance so that it can be used as the gate electrode. It is, therefore, desired that the W film has a resistivity of not larger than 20 μΩcm. The resistance of the W film can be decreased by coarsening the crystalline particles. When W contains much impurity elements such as oxygen, the crystallization is impaired and the resistance increases. When the sputtering method is employed, therefore, a W target having a purity of 99.9999% is used, and the W film is formed while giving a sufficient degree of attention so that the impurities will not be infiltrated from the gaseous phase during the formation of the film, to realize the resistivity of from 9 to 20 μΩcm.

On the other hand, the Ta film that is used as the heat-resistant conductive layer 907 can similarly be formed by the sputtering method. The Ta film is formed by using Ar as a sputtering gas. Further, the addition of suitable amounts of Xe and Kr into the gas during the sputtering makes it possible to relax the internal stress of the film that is formed and to prevent the film from being peeled off. The Ta film of α-phase has a resistivity of about 20 μΩcm and can be used as the gate electrode but the Ta film of β-phase has a resistivity of about 180 μΩcm and is not suited for use as the gate electrode. The TaN film has a crystalline structure close to the α-phase. Therefore, if the TaN film is formed under the Ta film, there is easily formed the Ta film of α-phase. Further, though not diagramed, formation of the silicon film doped with phosphorus (P) maintaining a thickness of about 2 to about 20 nm under the heat resistant conductive layer 907 is effective in fabricating the device. This helps improve the intimate adhesion of the conductive film formed thereon, prevent the oxidation, and prevent trace amounts of alkali metal elements contained in the heat resistant conductive layer 907 from being diffused into the gate insulating film 906 of the first shape. In any way, it is desired that the heat-resistant conductive layer 907 has a resistivity over a range of from 10 to 50 μΩcm.

Next, a mask 908 is formed by a resist relying upon the photolithographic technology. Then, a first etching is executed. This embodiment uses an ICP etching device, uses $Cl_2$ and $CF_4$ as etching gases, and forms a plasma with RF (13.56 MHz) electric power of 3.2 W/cm$^2$ under a pressure of 1 Pa. The RF (13.56 MHz) electric power of 224 mW/cm$^2$ is supplied to the side of the substrate (sample stage), too, whereby a substantially negative self bias voltage is applied. Under this condition, the W film is etched at a rate of about 100 nm/min. The first etching treatment is effected by estimating the time by which the W film is just etched relying upon this etching rate, and is conducted for a period of time which is 20% longer than the estimated etching time.

The conductive layers 909 to 912 having a first tapered shape are formed by the first etching treatment. The conductive layers 909 to 912 are tapered at an angle of from 15 to 30°. To execute the etching, without leaving residue, over-etching is conducted by increasing the etching time by about 10 to 20%. The selection ratio of the silicon oxynitride film (gate insulating film 906) to the W film is 2 to 4 (typically, 3). Due to the over etching, therefore, the surface where the silicon oxynitride film is exposed is etched by about 20 to about 50 nm (FIG. 8(B)).

Then, a first doping treatment is effected to add an impurity element of a first type of electric conduction to the semiconductor layer. Here, a step is conducted to add an impurity element for imparting the n-type. A mask 908 forming the conductive layer of a first shape is left, and an impurity element is added by the ion-doping method to impart the n-type in a self-aligned manner with the conductive layers 909 to 912 having a first tapered shape as masks. The dosage is set to be from $1\times10^{13}$ to $5\times10^{14}$ atoms/cm$^2$ so that the impurity element for imparting the n-type reaches the underlying semiconductor layer penetrating through the tapered portion and the gate insulating film 906 at the ends of the gate electrode, and the acceleration voltage is selected to be from 80 to 160 keV. As the impurity element for imparting the n-type, there is used an element belonging to the Group 15 and, typically, phosphorus (P) or arsenic (As). Phosphorus (P) is used, here. Due to the ion-doping method, an impurity element for imparting the n-type is added to the first impurity regions 914 to 917 over a concentration range of from $1\times10^{20}$ to $1\times10^{21}$ atoms/cm$^3$ (FIG. 8(C)).

In this step, the impurities turn down to the lower side of the conductive layers 909 to 912 of the first shape depending upon the doping conditions, and it often happens that the first impurity regions 914 to 917 are overlapped on the conductive layers 909 to 912 of the first shape.

Figures 8A, 8B, 8C, 8D:
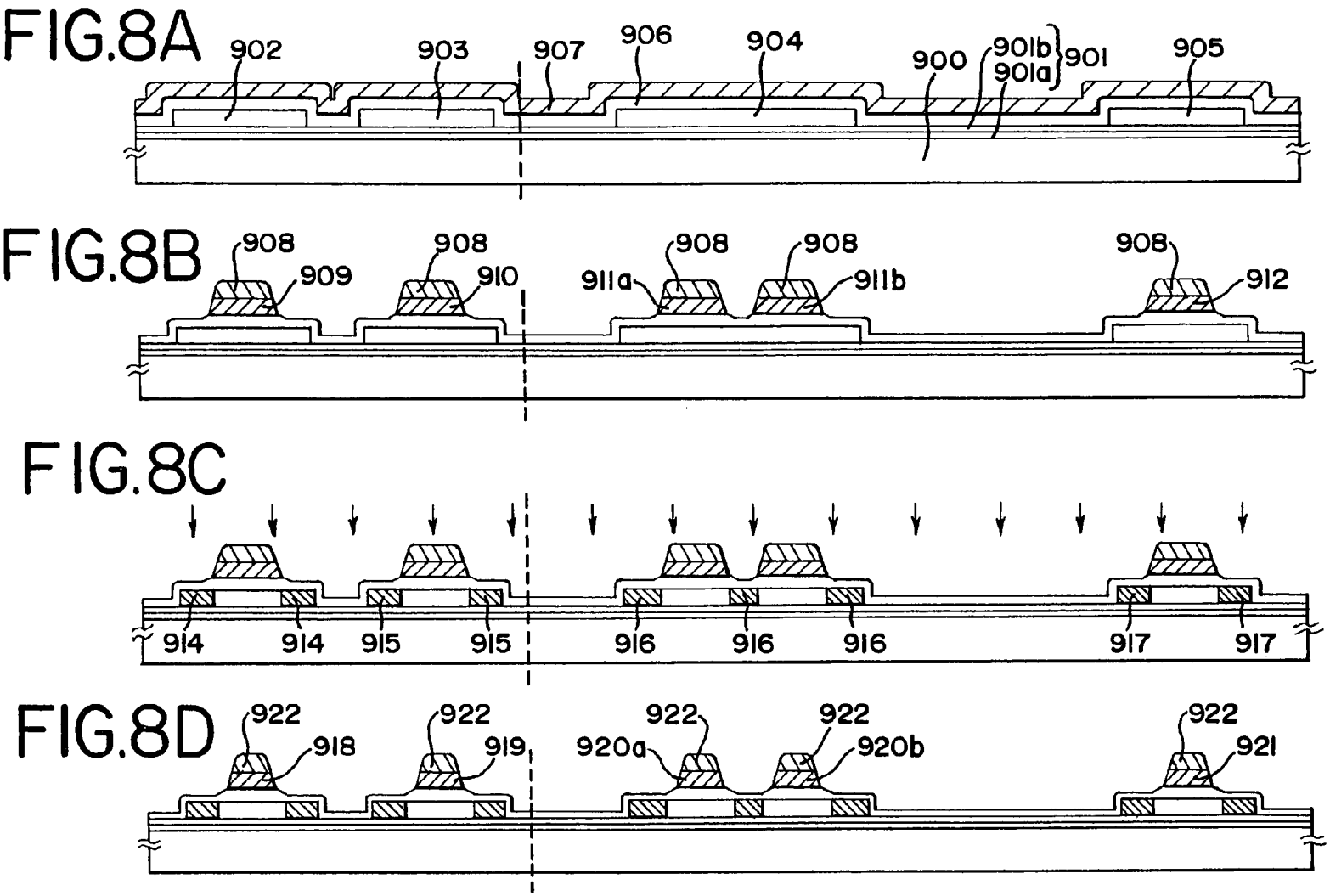
FIGS. 8A to 8D show a method of manufacturing a light emitting device.

Next, the second etching treatment is conducted as shown in FIG. 8(D). The etching treatment, too, is conducted by using the ICP etching device, using a mixed gas of $CF_4$ and $Cl_2$ as an etching gas, using an RF electric power of 3.2 W/cm$^2$ (13.56 MHz), a bias power of 45 mW/cm$^2$ (13.56 MHz) under a pressure of 1.0 Pa. Under this condition, there are formed the conductive layers 918 to 921 of a second shape. The end portions thereof are tapered, and the thicknesses gradually increase from the ends toward the inside. The rate of isotropic etching increases in proportion to a decrease in the bias voltage applied to the side of the substrate as compared to the first etching treatment, and the angle of the tapered portions becomes 30 to 60°. The mask 908 is ground at the edge by etching to form a mask 922. In the step of FIG. 8(D), the surface of the gate insulating film 906 is etched by about 40 nm.

Then, the doping is effected with an impurity element for imparting the n-type under the condition of an increased acceleration voltage by decreasing the dosage to be smaller than that of the first doping treatment. For example, the acceleration voltage is set to be from 70 to 120 keV, the dosage is set to be $1\times10^{13}$/cm$^2$ thereby to form first impurity regions 924 to 927 having an increased impurity concentration, and second impurity regions 928 to 931 that are in contact with the first impurity regions 924 to 927. In this step, the impurity may turn down to the lower side of the conductive layers 918 to 921 of the second shape, and the second impurity regions 928 to 931 may be overlapped on the conductive layers 918 to 921 of the second shape. The impurity concentration in the second impurity regions is from $1\times10^{16}$ to $1\times10^{18}$ atoms/cm$^3$ (FIG. 9(A)).

Figure 9A:
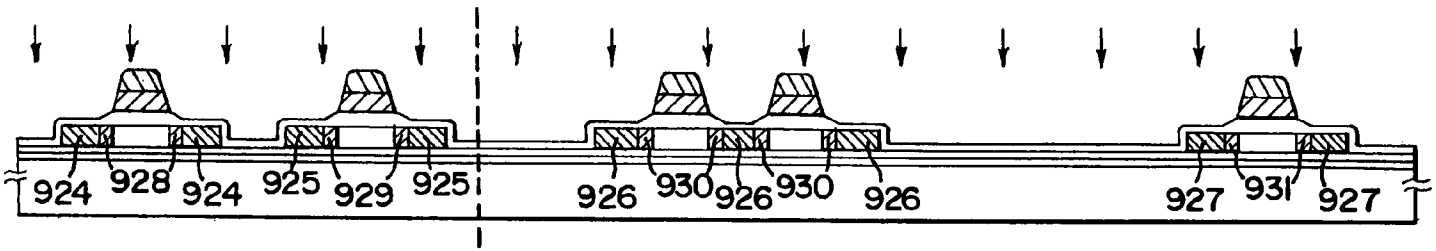
FIGS. 9A to 9C show a method of manufacturing the light emitting device.
Figure 9B:
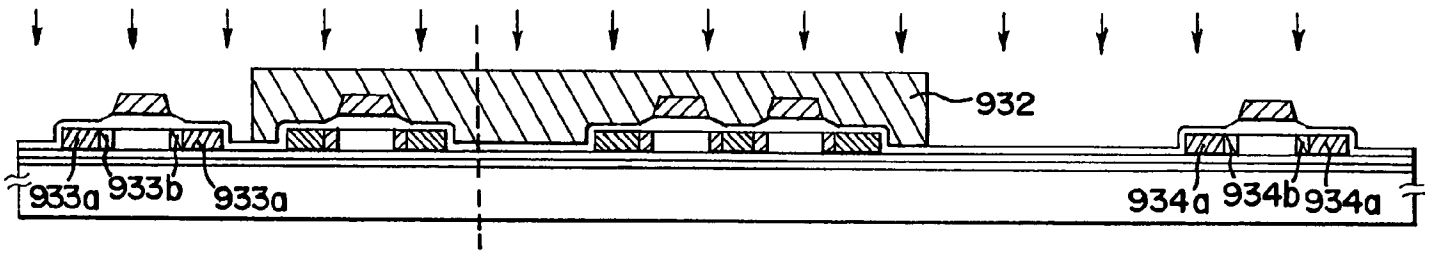

Referring to FIG. 9(B), impurity regions 933 (933*a*, 933*b*) and 934 (934*a*, 934*b*) of the conductive type opposite to the one conduction type are formed in the semiconductor layers 902, 905 that form the p-channel TFTs. In this case, too, an impurity element for imparting the p-type is added using the conductive layers 918, 921 of the second shape as masks to form impurity regions in a self-aligned manner. At this moment, the semiconductor layers 903 and 904 forming the n-channel TFTs are entirely covered for their surfaces by forming a mask 932 of a resist. Here, the impurity regions 933 and 934 are formed by the ion-doping method by using diborane ($B_2H_6$). The impurity element for imparting the p-type is added to the impurity regions 933 and 934 at a concentration of from $2\times10^{20}$ to $2\times10^{21}$ atoms/cm$^3$.

If closely considered, however, the impurity regions 933, 934 can be divided into two regions containing an impurity element that imparts the n-type. Third impurity regions 933*a* and 934*a* contain the impurity element that imparts the n-type at a concentration of from $1\times10^{20}$ to $1\times10^{21}$ atoms/cm$^3$ and fourth impurity regions 933*b* and 934*b* contain the impurity element that imparts the n-type at a concentration of from $1\times10^{17}$ to $1\times10^{20}$ atoms/cm$^3$. In the impurity regions 933*b* and 934*b*, however, the impurity element for imparting the p-type is, contained at a concentration of not smaller than $1\times10^{19}$ atoms/cm$^3$ and in the third impurity regions 933*a* and 934*a*, the impurity element for imparting the p-type is contained at a concentration which is 1.5 to 3 times as high as the concentration of the impurity element for imparting the n-type. Therefore, the third impurity regions work as source regions and drain regions of the p-channel TFTs without arousing any problem.

Figure 9C:
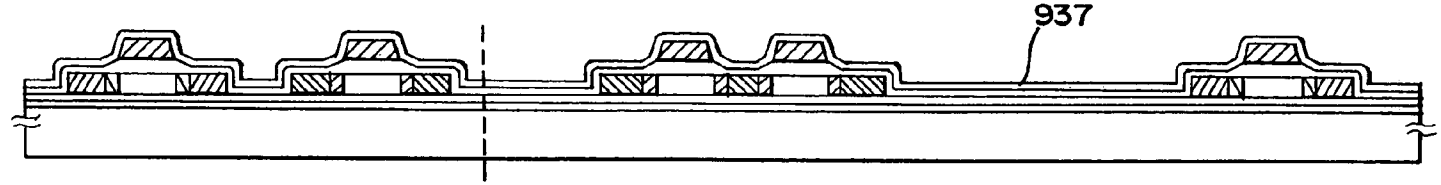

Referring next to FIG. 9(C), a first interlayer insulating film 937 is formed on the conductive layers 918 to 921 of the second shape and on the gate insulating film 906. The first interlayer insulating film 937 may be formed of a silicon oxide film, a silicon oxynitride film, a silicon nitride film, or a laminated layer film of a combination thereof. In any case, the first interlayer insulating film 937 is formed of an inorganic insulating material. The first interlayer insulating film 937 has a thickness of 100 to 200 nm. When the silicon oxide film is used as the first interlayer insulating film 937, TEOS and $O_2$ are mixed together by the plasma CVD method, and are reacted together under a pressure of 40 Pa at a substrate temperature of 300 to 400° C. while discharging the electric power at a high frequency (13.56 MHz) and at a power density of 0.5 to 0.8 W/cm$^2$. When the silicon oxynitride film is used as the first interlayer insulating film 937, this silicon oxynitride film may be formed from $SiH_4$, $N_2O$ and $NH_3$, or from $SIH_4$ and $N_2O$ by the plasma CVD method. The conditions of formation in this case are a reaction pressure of from 20 to 200 Pa, a substrate temperature of from 300 to 400° C. and a high-frequency (60 MHz) power density of from 0.1 to 1.0 W/cm$^2$. As the first interlayer insulating film 937, further, there may be used a hydrogenated silicon oxynitride film formed by using $SiH_4$, $N_2O$ and $H_2$. The silicon nitride film, too, can similarly be formed by using $SiH_4$ and $NH_3$ by the plasma CVD method.

Then, a step is conducted for activating the impurity elements that impart the n-type and the p-type added at their respective concentrations. This step is conducted by thermal annealing method using an annealing furnace. There can be further employed a laser annealing method or a rapid thermal annealing method (RTA method). The thermal annealing method is conducted in a nitrogen atmosphere containing oxygen at a concentration of not higher than 1 ppm and, preferably, not higher than 0.1 ppm at from 400 to 700° C. and, typically, at from 500 to 600° C. In this embodiment, the heat treatment is conducted at 550° C. for 4 hours. When a plastic substrate having a low heat resistance temperature is used as the substrate 501, it is desired to employ the laser annealing method.

Following the step of activation, the atmospheric gas is changed, and the heat treatment is conducted in an atmosphere containing 3 to 100% of hydrogen at from 300 to 450° C. for from 1 to 12 hours to hydrogenate the semiconductor layer. This step is to terminate the dangling bonds of $10^{16}$ to $10^{18}$/cm$^3$ in the semiconductor layer with hydrogen that is thermally excited. As another means of hydrogenation, the plasma hydrogenation may be executed (using hydrogen excited with plasma). In any way, it is desired that the defect density in the semiconductor layers 902 to 905 is suppressed to be not larger than $10^{16}$/cm$^3$. For this purpose, hydrogen may be added in an amount of from 0.01 to 0.1 atomic %.

Then, a second interlayer insulating film 939 of an organic insulating material is formed maintaining an average thickness of from 1.0 to 2.0 μm. As the organic resin material, there can be used polyimide, acrylic, polyamide, polyimideamide and BCB (benzocyclobutene). When there is used, for example, a polyimide of the type that is heat polymerized after being applied onto the substrate, the second interlayer insulating film is formed being fired in a clean oven at 300° C. When there is used an acrylic resin, there is used the one of the two-can type. Namely, the main material and a curing agent are mixed together, applied onto the whole surface of the substrate by using a spinner, pre-heated by using a hot plate at 80° C. for 60 seconds, and are fired at 250° C. for 60 minutes in a clean oven to form the second interlayer insulating film.

Thus, the second interlayer insulating film 939 is formed by using an organic insulating material featuring good and flattened surface. Further, the organic resin material, in general, has a small dielectric constant and lowers the parasitic capacitance. The organic resin material, however, is hygroscopic and is not suited as a protection film. It is, therefore, desired that the second interlayer insulating film is used in combination with the silicon oxide film, silicon oxynitride film or silicon nitride film formed as the first interlayer insulating film 937.

Figure 10A:
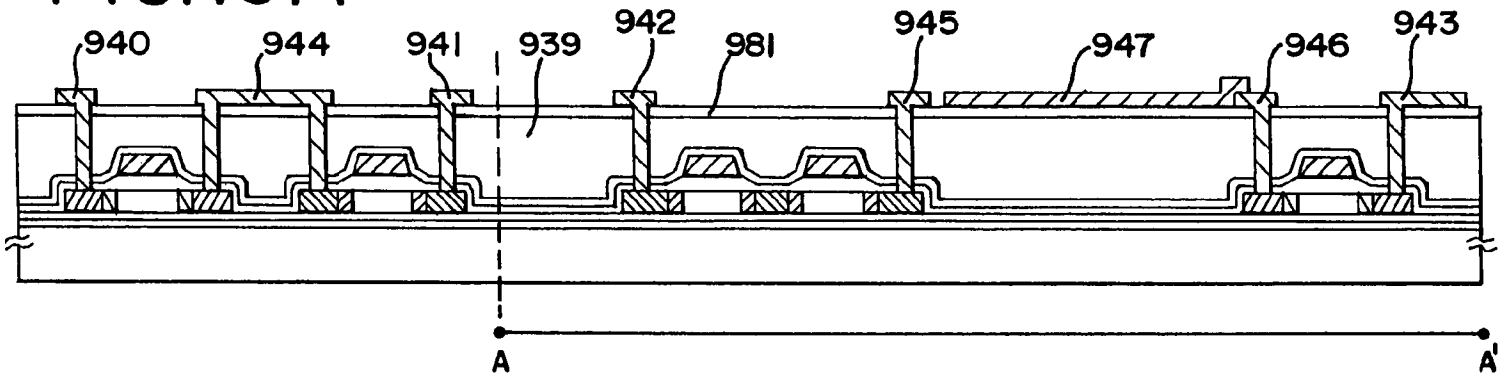
FIGS. 10A and 10B show a method of manufacturing the light emitting device.

Next, as shown in FIG. 10A, after forming the second interlayer insulating film 939, the passivation film 939 is formed so as to connect to the second interlayer insulating film 939.

The passivation film 939 is effective to prevent the moisture contained in the second interlayer insulating film 939 from entering the organic light emitting 939 via the pixel electrode 947 and the third interlayer insulating film 982. It is especially effective to provide the passivation film 939 because the organic resin material contains a lot of moisture when the second interlayer insulating film 939 has the organic resin material.

In this embodiment, the silicon nitride film is used as the passivation film 939.

Thereafter, the resist mask of a predetermined pattern is formed, and contact holes are formed in the semiconductor layers to reach the impurity regions serving as source regions or drain regions. The contact holes are formed by dry etching. In this case, a mixed gas of $CF_4$ and $O_2$ is used as the etching gas to, first, etch the passivation film 939, and then a mixed gas of $CF_4$, $O_2$ and He is used as the etching gas to etch the second interlayer insulating film 939 of the organic resin material. Thereafter, $CF_4$ and $O_2$ are used as the etching gas to etch the first interlayer insulating film 937. In order to further enhance the selection ratio relative to the semiconductor layer, $CHF_3$ is used as the etching gas to etch the gate insulating film 570 of the third shape, thereby to form the contact holes.

Here, the conductive metal film is formed by sputtering and vacuum vaporization and is patterned by using a mask and is, then, etched to form source wirings 940 to 943, drain wirings 944 to 946. Further, though not diagramed in this embodiment, the wiring is formed by a laminate of a 50 nm thick Ti film and a 500 nm thick alloy film (alloy film of Al and Ti).

Then, a transparent conductive film is formed thereon maintaining a thickness of 80 to 120 nm, and is patterned to form a pixel electrode 947 (FIG. 10(A)). Therefore, the pixel electrode 947 is formed by using an indium oxide-tin (ITO) film as a transparent electrode or a transparent conductive film obtained by mixing 2 to 20% of a zinc oxide (ZnO) into indium oxide.

Further, the pixel electrode 947 is formed being in contact with, and overlapped on, the drain wiring 946 that is electrically connected to the drain region of the driver TFT.

Figure 11:
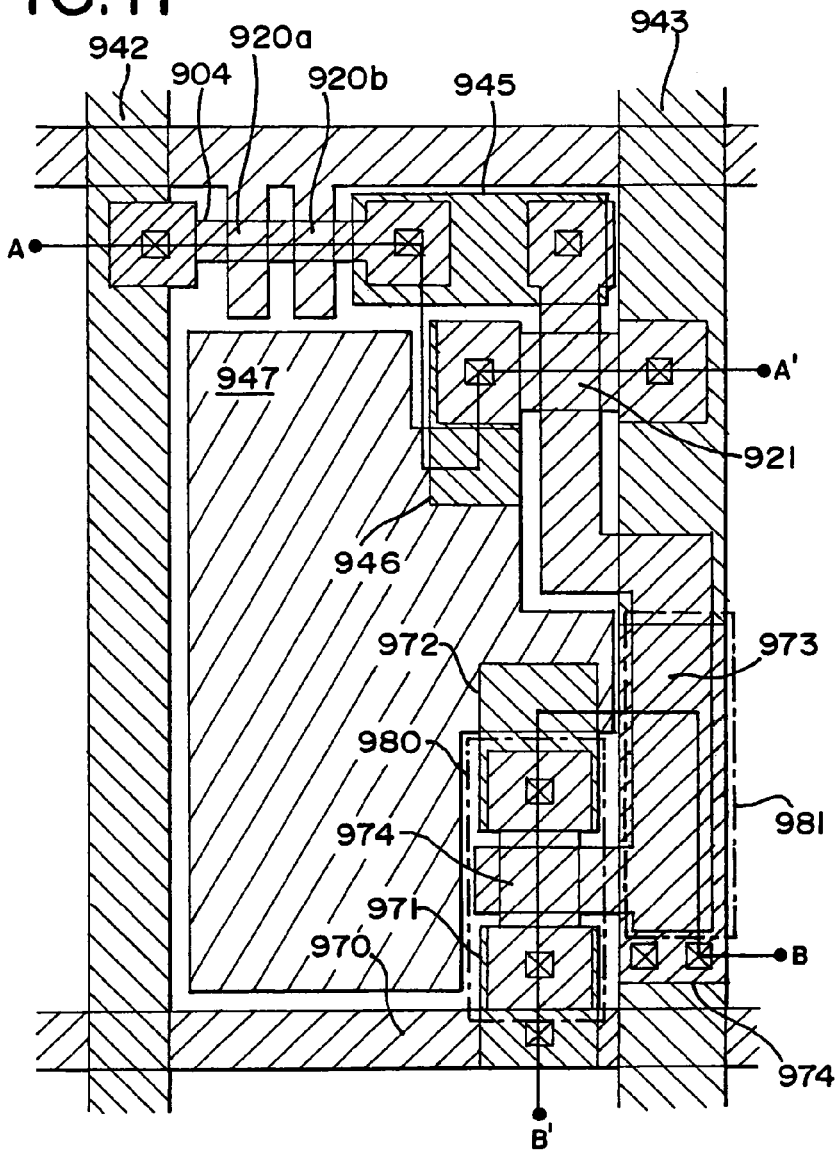
FIG. 11 is a top view of a pixel in the light emitting device.
Figure 12:
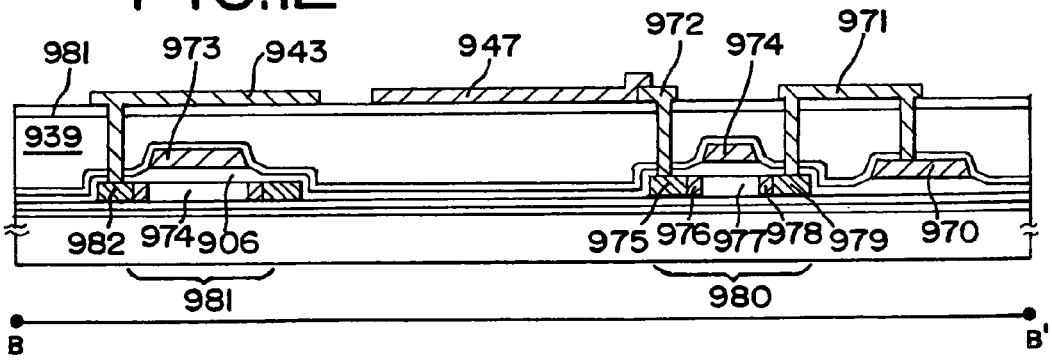
FIG. 12 shows a method of manufacturing a light emitting device.

The top surface view of the pixel in which the pixel electrode 947 had already been formed is shown in FIG. 11. The cross reference taken along the line A-A' is corresponding to the figure of the pixel portion of FIG. 10A. In addition, the reference numeral 780 is the discharge TFT and 781 is the retention capacitor in FIG. 11. The cross reference taken along the line B-B' in FIG. 11 is shown in FIG. 12.

The retention capacitor 781 is having the capacitor wiring 793, the activation layer 974, the retention wiring 793, and the gate insulating film 906 formed between the activation layers 974. The impurity region 982 in the activation layer 974 is connected to the power source line 943.

The discharge TFT 780 has an activation layer which has a source region or a drain region 975, 979, the LDD region 976, 978 and the channel formation region 977. Further, the discharge TFT 780 has the gate electrode 974 and the gate insulating film 906 formed between the activation layer and the gate electrode 974.

The source region or the drain region 975 is connected to the pixel electrode 947 via the connecting wiring 972. Further, the source region or the drain region 979 is connected to the discharge line 970 via the connecting wiring 971.

Figure 10B:
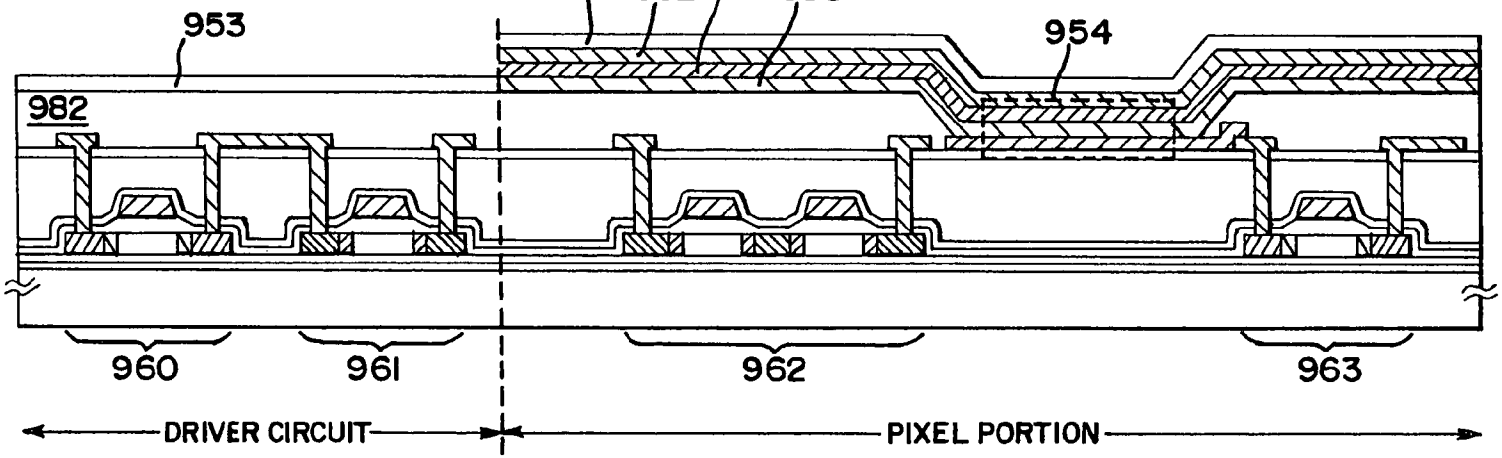

Next, as shown in FIG. 10B, the third interlayer insulating film 982 having an opening portion at the position corresponding to the pixel electrode 947 is formed. In this embodiment, side walls having a tapered shape are formed by using a wet etching method in forming the opening portion. In this case, the organic light emitting layer formed on the third interlayer insulating film 982 is not separated. Thus, the deterioration of the organic light emitting layer which derives from a step becomes a conspicuous problem if the side walls of the opening portion are not sufficiently gentle, which requires attention.

Note that although a film made of silicon oxide is used as the third interlayer insulating film 982 in this embodiment, an organic resin film such as polyimide, polyamide, acrylic or BCB (benzocyclobutene) may also be used depending on circumstances.

Then, it is preferable that, before the organic light emitting layer 950 is formed on the third interlayer insulating film 982, plasma processing using argon is conducted to the surface of the third interlayer insulating film 982 to make close the surface of the third interlayer insulating film 982. With the above structure, it is possible to prevent moisture from permeating the organic light emitting layer 950 from the third interlayer insulating film 982.

Next, the organic light emitting layer 950 is formed by an evaporation method, and further, the cathode (MgAg electrode) 951 and the protecting electrode 952 are formed by the evaporation method. At this time, it is desirable that heat treatment is conducted to the pixel electrode 947 to completely remove moisture prior to the formation of the organic light emitting layer 950 and the cathode 951. Note that, the MgAg electrode is used as the cathode of the OLED in this embodiment, but other known materials may also be used.

Note that a known material can be used for the organic light emitting layer 950. In this embodiment, the organic light emitting layer takes a two-layer structure constituted of a hole transporting layer and a light emitting layer. However, there may be a case where any one of a hole injecting layer, an electron injecting layer and an electron transporting layer is included in the organic light emitting layer. Various examples of combinations have been reported as described above, and any structure among those may be used.

In this embodiment, polyphenylene vinylene is formed by the evaporation method for forming the hole transporting layer. Further, polyvinylcarbazole dispersed with PBD of 1,3,4-oxadiazole derivative with 30 to 40% molecules is formed by the evaporation method for forming the light emitting layer, and about 1% of coumarin 6 is added thereto as the emission center of green color.

Further, it is possible to protect the organic light emitting layer 950 from moisture and oxygen in the protecting electrode 952, but the protective film 953 may be, more preferably, provided. In this embodiment, a silicon nitride film with a thickness of 300 nm is provided as the protective film 953. This protective film may be continuously formed without exposure to an atmosphere after the formation of the protecting electrode 952.

Moreover, the protecting electrode 952 is provided for preventing deterioration of the cathode 951 and is typified by a metal film containing aluminum as its main constituent. Of course, other materials may also be used. Further, since the organic light emitting layer 950 and the cathode 951 are extremely easily affected by moisture, it is desirable that the formation is continuously performed through the formation of the protecting electrode 952 without exposure to an atmosphere to thereby protect the organic light emitting layer against an outer atmosphere.

Note that the thickness of the organic light emitting layer 950 may be 10 to 400 nm (typically, 60 to 150 nm) and the thickness of the cathode 951 may be 80 to 200 nm (typically, 100 to 150 nm).

Thus, the light emitting device with the structure as shown in FIG. 10B is completed. Note that the portion 954, where the pixel electrode 947, the organic light emitting layer 950 and the cathode 951 are overlapped one another, corresponds to the OLED.

The p-channel TFT 960 and the n-channel TFT 961 are the TFTs of the driver circuit, and form a CMOS. The switching TFT 962 and the driver TFT 963 are the TFTs of the pixel portion. The TFTs of the driver circuit and the TFTs of the pixel portion can be formed on the same substrate.

The method of manufacturing the light emitting device of the present invention is not limited to the manufacturing method described in this embodiment. The light emitting device of the present invention can be manufactured by using a known method.

Note that this embodiment can be implemented by freely being combined with Embodiments 1 and 2.

Embodiment 4

Figure 13A:
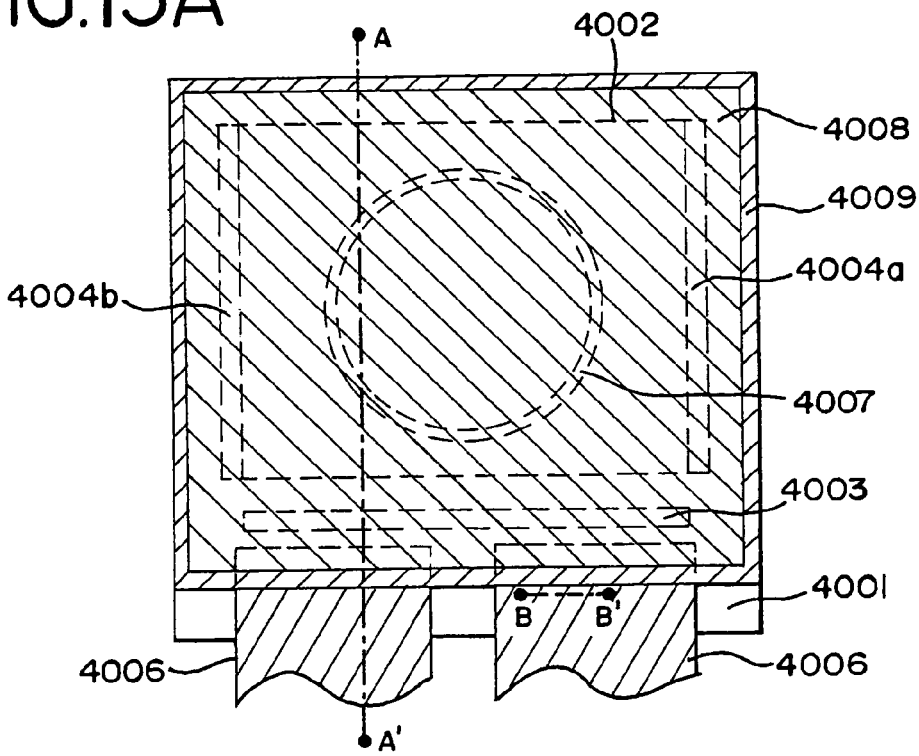
FIGS. 13A to 13C show an appearance of the light emitting device and cross-sections views thereof.
Figure 13B:
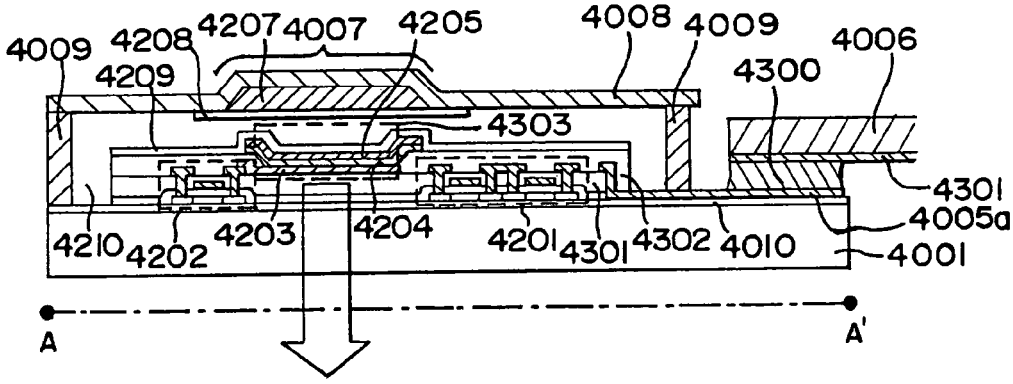
Figure 13C:
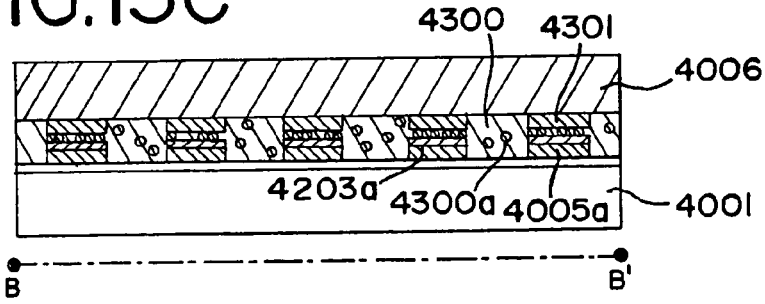

This embodiment describes with reference to FIGS. 13A to 13C as an appearance view of a light emitting device of the present invention.

FIG. 13A is a top view of a light emitting device in which a substrate (element substrate) with a TFT formed thereon is sealed by a sealing member. FIG. 13B is a sectional view taken along the line A-A' in FIG. 13A. FIG. 13C is a sectional view taken along the line B-B' in FIG. 13A.

A pixel portion 4002, a source line driver circuit 4003, and first and second scanning line driver circuits 4004*a* and 4004*b* are formed on a substrate 4001. A seal member 4009 is placed so as to surround them all on the substrate. A sealing member 4008 is provided on the pixel portion 4002, the signal line driver circuit 4003, and the first and second scanning line driver circuits 4004*a* and 4004*b*. Accordingly, the pixel portion 4002, the signal line driver circuit 4003, and the first and second scanning line driver circuits 4004*a* and 4004*b* are sealed in the space defined by the substrate 4001, the seal member 4009, and the sealing member 4008, with a filler 4210 filling the space.

The pixel portion 4002, the signal line driver circuit 4003, and the first and second scanning line driver circuits 4004*a* and 4004*b* on the substrate 4001 each have a plurality of TFTs. FIG. 13B shows, as representatives of those TFTs, a driver circuit TFT (composed of an n-channel TFT and a p-channel TFT in FIG. 13B) 4201 included in the signal line driver circuit 4003 and a driver TFT (a TFT for controlling a current flowing into the OLED) 4202 included in the pixel portion 4002. The TFTs 4201 and 4202 are formed on a base film 4010.

In this embodiment, the n-channel TFT or the p-channel TFT that constitutes the driver circuit TFT 4201 is manufactured by a known method, and a p-channel TFT manufactured by a known method is used for the driver TFT 4202. The pixel portion 4002 is provided with a capacitor storage (not shown) connected to a gate of the driver TFT 4202.

Formed on the driver circuit TFT 4201 and the driver TFT 4202 is an interlayer insulating film (planarization film) 4301, on which a pixel electrode (anode) 4203 is formed to be electrically connected to a drain of the driver TFT 4202. The pixel electrode 4203 is formed of a transparent conductive film having a large work function. Examples of the usable transparent conductive film material include a compound of indium oxide and tin oxide, a compound of indium oxide and zinc oxide, zinc oxide alone, tin oxide alone, and indium oxide alone. A transparent conductive film formed of one of these materials and doped with gallium may also be used for the pixel electrode.

An insulating film 4302 is formed on the pixel electrode 4203. An opening is formed in the insulating film 4302 above the pixel electrode 4203. At the opening above the pixel electrode 4203, an organic light emitting layer 4204 is formed. The organic light emitting layer 4204 is formed of a known organic luminous material or inorganic luminous material. Either low molecular weight (monomer) organic luminous materials or high molecular weight (polymer) organic luminous materials can be used for the organic light emitting layer.

The organic light emitting layer 4204 is formed by a known evaporation technique or application technique. The organic light emitting layer may consist solely of a light emitting layer. Alternatively, the organic light emitting layer may be a laminate having, in addition to a light emitting layer, a hole injection layer, a hole transporting layer, a light emitting layer, an electron transporting layer, and an electron injection layer in any combination.

A cathode 4205 is formed on the organic light emitting layer 4204 from a light-shielding conductive film (typically, a conductive film mainly containing aluminum, copper, or silver, or a laminate consisting of the above conductive film and other conductive films). Desirably, moisture and oxygen are removed as much as possible from the interface between the cathode 4205 and the organic light emitting layer 4204. Some contrivance is needed for the removal. For example, the organic light emitting layer 4204 is formed in a nitrogen or rare gas atmosphere and then the cathode 4205 is successively formed without exposing the substrate to moisture and oxygen. This embodiment uses a multi-chamber system (cluster tool system) film formation apparatus to achieve the film formation described above. The cathode 4205 receives a given voltage.

An OLED 4303 composed of the pixel electrode (anode) 4203, the organic light emitting layer 4204, and the cathode 4205 is thus formed. A protective film 4303 is formed on the insulating film 4302 so as to cover the OLED 4303. The protective film 4303 is effective in preventing oxygen and moisture from entering the OLED 4303.

Denoted by 4005*a* is a lead-out wiring line connected to a power supply line, and is electrically connected to a source region of the driver TFT 4202. The lead-out wiring line 4005*a* runs between the seal member 4009 and the substrate 4001 and is electrically connected to an FPC wiring line 4301 of an FPC 4006 through an anisotropic conductive film 4300.

The sealing member 4008 is formed of a glass material, a metal material (typically a stainless steel material), a ceramic material, or a plastic material (including a plastic film). Examples of the usable plastic material include an FRP (fiberglass-reinforced plastic) plate, a PVF (polyvinyl fluoride) film, a Mylar film, a polyester film, and an acrylic resin film. A sheet obtained by sandwiching an aluminum foil between PVF films or Mylar films may also be used.

However, if light emitted from the OLED travels toward the sealing member, the sealing member has to be transparent. In this case, a transparent material such as a glass plate, a plastic plate, a polyester film, or an acrylic film is used.

The filler 4103 may be inert gas such as nitrogen and argon, or a UV-curable resin or a thermally curable resin. Examples thereof include PVC (polyvinyl chloride), acrylic, polyimide, an epoxy resin, a silicone resin, PVB (polyvinyl butyral), and EVA (ethylene vinyl acetate). In this embodiment, nitrogen is used as the filler.

In order to expose the filler 4103 to a hygroscopic substance (preferably barium oxide) or a substance capable of adsorbing oxygen, a hygroscopic substance 4207, or a substance 4207 capable of adsorbing oxygen, is placed in a concave portion 4007 formed on a surface of the sealing member 4008 on the substrate 4001 side. The hygroscopic substance 4207, or a substance 4207 capable of adsorbing oxygen, is held down to the concave portion 4007 by a concave portion covering member 4208 to prevent hygroscopic substance 4207, or a substance 4207 capable of adsorbing oxygen, from scattering. The concave portion covering member 4208 is a dense mesh and allows air and moisture to pass but not the hygroscopic substance 4207, or a substance 4207 capable of adsorbing oxygen. The hygroscopic substance 4207, or a substance 4207 capable of adsorbing oxygen, can prevent degradation of the OLED 4303.

As shown in FIG. 13C, a conductive film 4203*a* is formed to be brought into contact with the top face of the lead-out wiring line 4005*a* at the same time the pixel electrode 4203 is formed. The anisotropic conductive film 4300 has a conductive filler 4300*a*. The conductive filler 4300*a* electrically connects the conductive film 4203*a* on the substrate 4001 to the FPC wiring line 4301 on the FPC 4006 upon thermal press fitting of the substrate 4001 and the FPC 4006.

This embodiment may be combined freely with Embodiments 1 to 3.

Embodiment 5

In this embodiment, an external light emitting quantum efficiency can be remarkably improved by using an organic light emitting material by which phosphorescence from a triplet exciton can be employed for emitting a light. As a result, the power consumption of the OLED element can be reduced, the lifetime of the OLED element can be elongated and the weight of the OLED element can be lightened.

The following is a report where the external light emitting quantum efficiency is improved by using the triplet exciton (T. Tsutsui, C. Adachi, S. Saito, Photochemical processes in Organized Molecular Systems, ed. K. Honda, (Elsevier Sci. Pub., Tokyo, 1991) p. 437).

The molecular formula of an organic light emitting material (coumarin pigment) reported by the above article is represented as follows.

(Chemical formula 1)

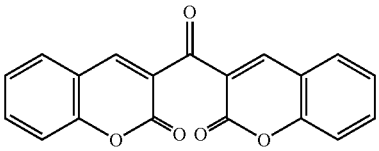

(M. A. Baldo, D. F. O' Brien, Y. You, A. Shoustikov, S. Sibley, M. E. Thompson, S. R. Forrest, Nature 395 (1998) p. 151)

The molecular formula of an organic light emitting material (Pt complex) reported by the above article is represented as follows.

(Chemical formula 2)

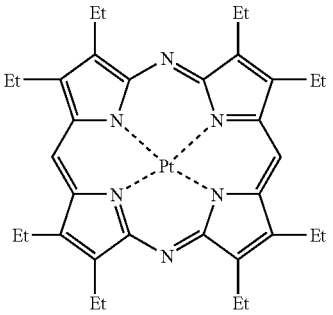

(M. A. Baldo, S. Lamansky, P. E. Burrows, M. E. Thompson, S. R. Forrest, Appl. Phys. Lett., 75 (1999) p. 4.)

(T. T sutsui, M.-J. Yang, M. Yahiro, K. Nakamura, T. Watanabe, T. Tsuji, Y. Fukuda. T. Wakimoto, S. Mayaguchi, Jpn, Appl. Phys., 38 (12B)(1999) L1502)

The molecular formula of an organic light emitting material (Ir complex) reported by the above article is represented as follows.

(Chemical formula 3)

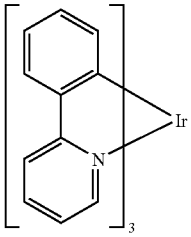

As described above, if phosphorescence from a triplet exciton can be put to practical use, it can realize the external light emitting quantum efficiency three to four times as high as that in the case of using fluorescence from a singlet exciton in principle.

The structure according to this embodiment can be freely implemented in combination of any structures of Embodiments 1 to 4.

Embodiment 6

Being self-luminous, a light emitting device has better visibility in bright places and wider viewing angle than liquid crystal display devices. Therefore the light emitting device can be used for display units of various electric appliances.

Given as examples of an electric appliance that employs a light emitting device manufactured in accordance with the present invention are video cameras, digital cameras, goggle type displays (head mounted displays), navigation systems, audio reproducing devices (such as car audio and audio components), lap-top computers, game machines, portable information terminals (such as mobile computers, cellular phones, portable game machines, and electronic books), and image reproducing devices equipped with recording media (specifically, devices with a display device that can reproduce data in a recording medium such as a digital video disk (DVD) to display an image of the data). Wide viewing angle is important particularly for portable information terminals because their screens are often slanted when they are looked at. Therefore it is preferable for portable information terminals to employ the light emitting device using the organic light emitting element. Specific examples of these electric appliance are shown in FIGS. 14A to 14H.

Figure 14A:
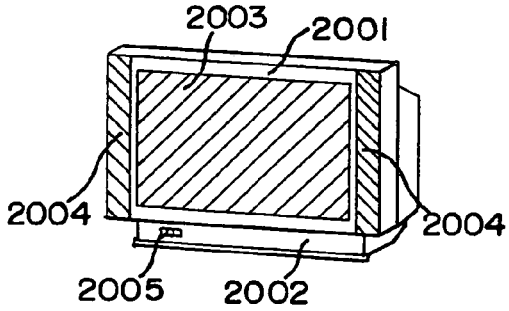
FIGS. 14A to 14H show electronic devices using the light emitting device of the present invention.

FIG. 14A shows an OLED display device, which is composed of a case 2001, a support base 2002, a display unit 2003, speaker units 2004, a video input terminal 2005, etc. The light emitting device manufactured in accordance with the present invention can be applied to the display unit 2003. Since the light emitting device is self-luminous, the device does not need back light and can make a thinner display unit than liquid crystal display devices. The OLED display device refers to all display devices for displaying information, including ones for personal computers, for TV broadcasting reception, and for advertisement.

Figure 14B:
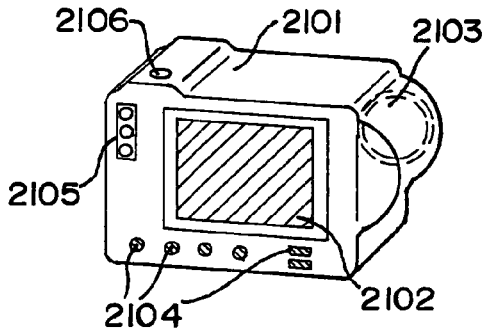

FIG. 14B shows a digital still camera, which is composed of a main body 2101, a display unit 2102, an image receiving unit 2103, operation keys 2104, an external connection port 2105, a shutter 2106, etc. The light emitting device manufactured in accordance with the present invention can be applied to the display unit 2102.

Figure 14C:
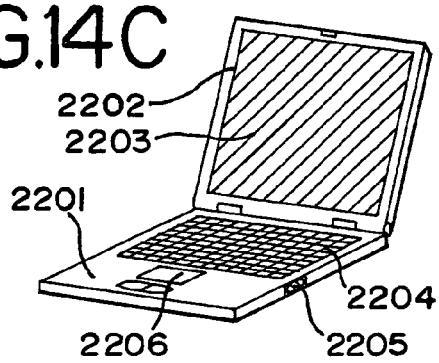

FIG. 14C shows a lap-top personal computer, which is composed of a main body 2201, a case 2202, a display unit 2203, a keyboard 2204, an external connection port 2205, a pointing mouse 2206, etc. The light emitting device manufactured in accordance with the present invention can be applied to the display unit 2203.

Figure 14D:
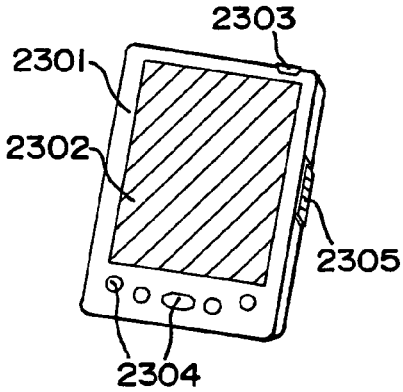

FIG. 14D shows a mobile computer, which is composed of a main body 2301, a display unit 2302, a switch 2303, operation keys 2304, an infrared port 2305, etc. The light emitting device manufactured in accordance with the present invention can be applied to the display unit 2302.

Figure 14E:
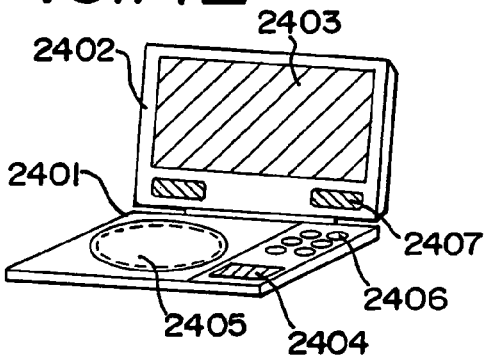

FIG. 14E shows a portable image reproducing device equipped with a recording medium (a DVD player, to be specific). The device is composed of a main body 2401, a case 2402, a display unit A 2403, a display unit B 2404, a recording medium (DVD or the like) reading unit 2405, operation keys 2406, speaker units 2407, etc. The display unit A 2403 mainly displays image information whereas the display unit B 2404 mainly displays text information. The light emitting device manufactured in accordance with the present invention can be applied to the display units A 2403 and B 2404. The image reproducing device equipped with a recording medium also includes home-video game machines.

Figure 14F:
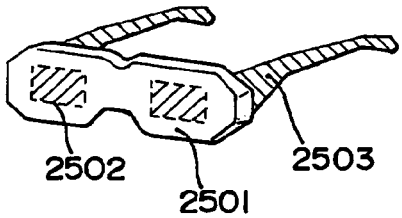

FIG. 14F shows a goggle type display (head mounted display), which is composed of a main body 2501, display units 2502, and arm units 2503. The light emitting device manufactured in accordance with the present invention can be applied to the display units 2502.

Figure 14G:
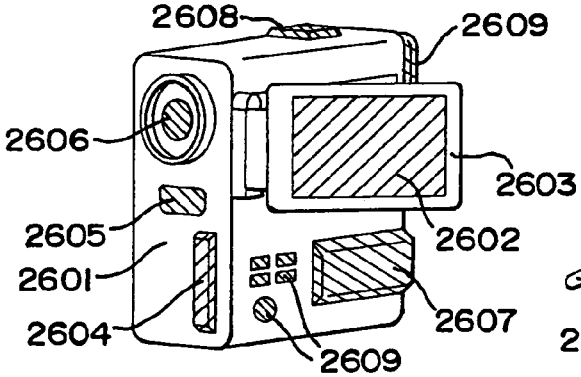

FIG. 14G shows a video camera, which is composed of a main body 2601, a display unit 2602, a case 2603, an external connection port 2604, a remote control receiving unit 2605, an image receiving unit 2606, a battery 2607, an audio input unit 2608, operation keys 2609, etc. The light emitting device manufactured in accordance with the present invention can be applied to the display unit 2602.

Figure 14H:
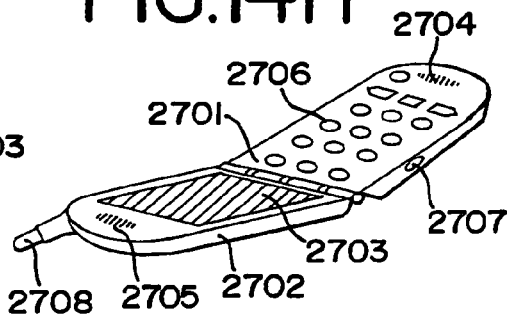

FIG. 14H shows a cellular phone, which is composed of a main body 2701, a case 2702, a display unit 2703, an audio input unit 2704, an audio output unit 2705, operation keys 2706, an external connection port 2707, an antenna 2708, etc. The light emitting device manufactured in accordance with the present invention can be applied to the display unit 2703. If the display unit 2703 displays white letters on black background, the cellular phone consumes less power.

If the luminance of light emitted from organic materials is raised in future, the light emitting device can be used in front or rear projectors by enlarging outputted light that contains image information through a lens or the like and projecting the light.

These electric appliances now display with increasing frequency information sent through electronic communication lines such as the Internet and CATV (cable television), especially, animation information. Since organic light emitting materials have very fast response speed, the light emitting device is suitable for animation display.

In the light emitting device, light emitting portions consume power and therefore it is preferable to display information in a manner that requires less light emitting portions. When using the light emitting device in display units of portable information terminals, particularly cellular phones and audio reproducing devices that mainly display text information, it is preferable to drive the device such that non-light emitting portions form a background and light emitting portions form text information.

As described above, the application range of the light emitting device manufactured in accordance with the present invention is so wide that it is applicable to electric appliances of any field. The electric appliances of this embodiment can employ any light emitting device disclosed in Embodiments 1 to 5.

According to the above structure, in the light emitting device of the present invention, even if an off current flows into the driver TFT, the off current flows into the discharge line through the discharging TFT. Thus, almost no current flows into the OLED. Therefore, light emission of the OLED is prevented, a reduction in a contrast is suppressed, and disturbance of a displayed image can be prevented.

Also, according to the light emitting device of the present invention, afterglow produced when the EL driver TFT is turned off can be prevented more effectively, as compared with the general light emitting device.

What is claimed is:

1. A display device comprising:

a light emitting element;

a first TFT and a second TFT;

a power source line; and a discharge line, wherein the light emitting element is connected to the power source line through the first TFT, wherein the light emitting element is connected to the discharge line through the second TFT, wherein an impurity region of the second TFT is connected to the discharge line, and wherein when one of the first TFT and the second TFT is in an on state, the other is in an off state.

2. A display device according to claim 1, wherein switchings of the first TFT and the second TFT are controlled by a digital video signal.

3. An electronic appliance having the display device according to claim 1, wherein the electronic appliance is selected from the group consisting of a video camera, a digital camera, a goggle type display, a navigation system, an audio reproducing device, a lap-top computer, a game machine, a portable information terminals and an image reproducing device.

4. A display device comprising:

a light emitting element;

a first TFT and a second TFT;

a power source line; and a discharge line, wherein the light emitting element is connected to the power source line through the first TFT, wherein the light emitting element is connected to the discharge line through the second TFT, wherein an impurity region of the second TFT is connected to the discharge line, wherein one of the first TFT and the second TFT is a p-channel TFT and the other is an n-channel TFT, wherein a gate electrode of the first TFT and that of the second TFT are connected to each other, and wherein when one of the first TFT and the second TFT is in an on state, the other is in an off state.

5. A display device according to claim 4, wherein switchings of the first TFT and the second TFT are controlled by a digital video signal.

6. An electronic appliance having the display device according to claim 4, wherein the electronic appliance is selected from the group consisting of a video camera, a digital camera, a goggle type display, a navigation system, an audio reproducing device, a lap-top computer, a game machine, a portable information terminals and an image reproducing device.

7. A display device comprising:

a light emitting element having a light emitting layer formed between a first electrode and second electrode;

a first TFT and a second TFT;

a power source line; and a discharge line, wherein the first electrode is connected to the power source line through the first TFT, wherein the first electrode is connected to the discharge line through the second TFT, wherein when a potential of the second electrode is lower than that of the power source line, a potential of the discharge line is lower than that of the power source line, wherein when a potential of the second electrode is higher than that of the power source line, a potential of the discharge line is higher than that of the power source line, and wherein when one of the first TFT and the second TFT is in an on state, the other is in an off state.

8. A display device according to claim 7, wherein switchings of the first TFT and the second TFT are controlled by a digital video signal.

9. An electronic appliance having the display device according to claim 7, wherein the electronic appliance is selected from the group consisting of a video camera, a digital camera, a goggle type display, a navigation system, an audio reproducing device, a lap-top computer, a game machine, a portable information terminals and an image reproducing device.

10. A display device comprising:

a light emitting element having a light emitting layer formed between a first electrode and second electrode;

a first TFT and a second TFT;

a power source line; and a discharge line, wherein the first electrode is connected to the power source line through the first TFT, wherein the first electrode is connected to the discharge line through the second TFT, wherein the first TFT is a p-channel TFT and the second TFT is an n-channel TFT, wherein a gate electrode of the first TFT and that of the second TFT are connected to each other, wherein when a potential of the second electrode is lower than that of the power source line, a potential of the discharge line is lower than that of the power source line, and wherein when a potential of the second electrode is higher than that of the power source line, a potential of the discharge line is higher than that of the power source line.

11. A display device according to claim 10, wherein switchings of the first TFT and the second TFT are controlled by a digital video signal.

12. An electronic appliance having the display device according to claim 10, wherein the electronic appliance is selected from the group consisting of a video camera, a digital camera, a goggle type display, a navigation system, an audio reproducing device, a lap-top computer, a game machine, a portable information terminals and an image reproducing device.

13. A display device comprising:

a light emitting element having a light emitting layer formed between a first electrode and second electrode;

a first TFT and a second TFT;

a power source line; and a discharge line, wherein a potential of the second electrode is higher than that of the power source line, wherein a potential of the discharge line is higher than that of the power source line, wherein the first electrode of the OLED is connected to the power source line through the first TFT, wherein the first electrode is connected to the discharge line through the second TFT, wherein the first TFT is a p-channel TFT and the second TFT is an n-channel TFT, and wherein a gate electrode of the first TFT and that of the second TFT are connected to each other.

14. A display device according to claim 13, wherein switchings of the first TFT and the second TFT are controlled by a digital video signal.

15. An electronic appliance having the display device according to claim 13, wherein the electronic appliance is selected from the group consisting of a video camera, a digital camera, a goggle type display, a navigation system, an audio reproducing device, a lap-top computer, a game machine, a portable information terminals and an image reproducing device.

16. A display device comprising:

a light emitting element having a light emitting layer formed between a first electrode and second electrode;

a first TFT and a second TFT;

a power source line; and a discharge line, wherein the second electrode and the discharge line are kept at the same potential, wherein the first electrode is connected to the power source line through the first TFT, wherein the first electrode is connected to the discharge line through the second TFT, and wherein when one of the first TFT and the second TFT is in an on state, the other is in an off state.

17. A display device according to claim 16, wherein switchings of the first TFT and the second TFT are controlled by a digital video signal.

18. An electronic appliance having the display device according to claim 16, wherein the electronic appliance is selected from the group consisting of a video camera, a digital camera, a goggle type display, a navigation system, an audio reproducing device, a lap-top computer, a game machine, a portable information terminals and an image reproducing device.

* * * * *

UNITED STATES PATENT AND TRADEMARK OFFICE

CERTIFICATE OF CORRECTION

PATENT NO. : 7,612,746 B2
APPLICATION NO. : 11/442456
DATED : November 3, 2009
INVENTOR(S) : Hajime Kimura It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 831 days.

Signed and Sealed this

Nineteenth Day of October, 2010

David J. Kappos

David J. Kappos
*Director of the United States Patent and Trademark Office*